US011415909B2

(12) United States Patent
Eguchi et al.

(10) Patent No.: US 11,415,909 B2
(45) Date of Patent: Aug. 16, 2022

(54) IMAGE FORMING APPARATUS AND METHOD FOR CONTROLLING THE SAME

(71) Applicant: KONICA MINOLTA, INC., Tokyo (JP)

(72) Inventors: Tatsuya Eguchi, Toyohashi (JP); Hiroshi Eguchi, Toyohashi (JP); Takashi Watanabe, Toyokawa (JP); Takeshi Ishida, Toyohashi (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 17/372,914

(22) Filed: Jul. 12, 2021

(65) Prior Publication Data

US 2022/0035265 A1 Feb. 3, 2022

(30) Foreign Application Priority Data

Jul. 28, 2020 (JP) ..... JP2020-127156

(51) Int. Cl.
*G03G 15/043* (2006.01)

(52) U.S. Cl.
CPC ..... *G03G 15/043* (2013.01)

(58) Field of Classification Search
CPC .... G03G 15/011; G03G 15/04; G03G 15/043; G03G 15/041; G03G 15/0415; G03G 2215/0429; G03G 2215/0426
See application file for complete search history.

(56) References Cited

U.S. PATENT DOCUMENTS

2019/0354034 A1* 11/2019 Mori ..... G03G 15/04072

FOREIGN PATENT DOCUMENTS

JP 2019155807 A 9/2019

* cited by examiner

*Primary Examiner* — Hoang X Ngo
(74) *Attorney, Agent, or Firm* — Buchanan Ingersoll & Rooney PC

(57) ABSTRACT

An image forming apparatus includes: a photoreceptor that forms a toner image; a light emission element that exposes the photoreceptor; at least one light emission controller that controls light emission of the light emission element; and a hardware processor that transmits a signal including a control parameter for controlling the light emission element with respect to the light emission controller, wherein the light emission controller stops light emission control over the light emission element according to communication that receives the signal including the control parameter from the hardware processor.

15 Claims, 18 Drawing Sheets

FIG. 18

| | | INITIALIZATION STABILIZATION | LONG (BRAND-NEW) STABILIZATION | SHORT STABILIZATION | RESIST+γ STABILIZATION | RESIST STABILIZATION | γ STABILIZATION | BLACK-AND-WHITE LONG (BRAND-NEW) STABILIZATION | BLACK-AND-WHITE SHORT STABILIZATION | BLACK-AND-WHITE γ STABILIZATION |
|---|---|---|---|---|---|---|---|---|---|---|
| VARIOUS STABILIZATION ADJUSTMENTS | SEQUENCE 1 | IDC SENSOR CALIBRATION CONTROL | IDC SENSOR CALIBRATION CONTROL | IDC BASE SURFACE DETECTION CONTROL | IDC BASE SURFACE DETECTION CONTROL | IDC BASE SURFACE DETECTION CONTROL | IDC BASE SURFACE DETECTION CONTROL | IDC SENSOR CALIBRATION CONTROL | IDC BASE SURFACE DETECTION CONTROL | IDC BASE SURFACE DETECTION CONTROL |
| | SEQUENCE 2 | ADHESION AMOUNT CONTROL | ADHESION AMOUNT CONTROL | ADHESION AMOUNT CONTROL | RESIST CONTROL (SHORT) | RESIST CONTROL (SHORT) | γ CORRECTION CONTROL (SHORT) | ADHESION AMOUNT CONTROL (BLACK-AND-WHITE) | ADHESION AMOUNT CONTROL (BLACK-AND-WHITE) | γ CORRECTION CONTROL (BLACK-AND-WHITE) |
| | SEQUENCE 3 | LD LIGHT AMOUNT CONTROL | LD LIGHT AMOUNT CONTROL | RESIST CONTROL (SHORT) | γ CORRECTION CONTROL (SHORT) | | | LD LIGHT AMOUNT CONTROL (BLACK-AND-WHITE) | LD LIGHT AMOUNT CONTROL (BLACK-AND-WHITE) | |
| | SEQUENCE 4 | RESIST CONTROL (LONG) | RESIST CONTROL (LONG) | LD LIGHT AMOUNT CONTROL | | | | ADHESION AMOUNT CONTROL (BLACK-AND-WHITE) | γ CORRECTION CONTROL (BLACK-AND-WHITE) | |
| | SEQUENCE 5 | ADHESION AMOUNT CONTROL | ADHESION AMOUNT CONTROL | γ CORRECTION CONTROL (SHORT) | | | | LD LIGHT AMOUNT CONTROL (BLACK-AND-WHITE) | | |
| | SEQUENCE 6 | LD LIGHT AMOUNT CONTROL | LD LIGHT AMOUNT CONTROL | | | | | γ CORRECTION CONTROL (BLACK-AND-WHITE) | | |
| | SEQUENCE 7 | γ CORRECTION CONTROL (LONG) | γ CORRECTION CONTROL (LONG) | | | | | | | |
| | SEQUENCE 8 | | | | | | | | | |
| ACTIVATION TIMING | AT END OF ENGINE INITIAL OPERATION | | ○ | ○ | | ○ | | ○ | ○ | |
| | DURING PRINT JOB (END) | | ○ | ○ | ○ | ○ | ○ | ○ | ○ | ○ |
| | BEFORE STARTING PRINT JOB | | ○ | ○ | ○ | ○ | | | | |
| | PANEL STABILIZATION | | | ○ | | | | | | |
| | PANEL INITIALIZATION | ○ | | | | | | | | |
| | PANEL GRADATION CORRECTION | | | ○ | | | | | | |

IMAGE FORMING APPARATUS AND METHOD FOR CONTROLLING THE SAME

The entire disclosure of Japanese patent Application No. 2020-127156, filed on Jul. 28, 2020, is incorporated herein by reference in its entirety.

BACKGROUND

Technological Field

The present disclosure relates to an image forming apparatus and a method for controlling the same.

Description of the Related Art

In recent years, electrophotographic image forming apparatuses using toner have been widely used. These image forming apparatuses form a toner image on a photoreceptor and transfer the toner image onto a sheet. In order to form a toner image on a surface of a photoreceptor, an image forming apparatus executes a charging process of forming an electric charge on the surface of the photoreceptor, an exposure process of forming an electrostatic latent image on the surface of the photoreceptor by emitting light onto the surface of the photoreceptor, and a development process of adhering toner to the surface of the photoreceptor.

The exposure process described above is executed by light emission control that is control by a light emission controller causing a light emission element to emit light. A controller that collectively controls an entire image forming apparatus controls light emission by transmitting a parameter or the like related to light emission control to the light emission controller via serial communication.

Regarding a technique for stabilizing light emission control, for example, JP 2019-155807 A discloses an image forming apparatus in which "a control unit, in forming images on a first sheet S on which images are formed and on a second sheet S on which images are formed consecutively following the first sheet S, when changing a target light quantity memorized in a target light-quantity register DAC between the first sheet S and the second sheet S and when serial communication is performed over a period of time during which a photoreceptor drum is scanned in plural times in order for a polygon mirror to form images on the first sheet S, performs settings of the serial communication so that timing for performing APC control does not overlap with timing for rewriting the target light quantity in the target light-quantity register DAC, with timing when a BD signal is outputted as a starting point for starting the serial communication." (refer to [Abstract]).

However, in serial communication between the controller and the light emission controller, register memories for serial communication incorporated in the light emission controller may be rewritten all at once, and a large number of flip-flop circuits may operate. As a result, the light emission controller temporarily consumes a large amount of power.

There have been a case where the light emission controller malfunctions when consuming a large amount of power, shifting a timing of light emission of the light emission element. Therefore, a technique for further stabilizing light emission control is required.

SUMMARY

The present disclosure has been made in view of the above circumstances, and an object of the present disclosure is to provide an image forming apparatus and a method for controlling the same, which can prevent a timing shift of light emission of a light emission element even in a case where a light emission controller receives a signal in serial communication.

To achieve the abovementioned object, according to an aspect of the present invention, an image forming apparatus reflecting one aspect of the present invention comprises: a photoreceptor that forms a toner image; a light emission element that exposes the photoreceptor; at least one light emission controller that controls light emission of the light emission element; and a hardware processor that transmits a signal including a control parameter for controlling the light emission element with respect to the light emission controller, wherein the light emission controller stops light emission control over the light emission element according to communication that receives the signal including the control parameter from the hardware processor.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 18 is a diagram showing a list of types of stabilization processing.

DETAILED DESCRIPTION OF EMBODIMENTS

Figure 1:
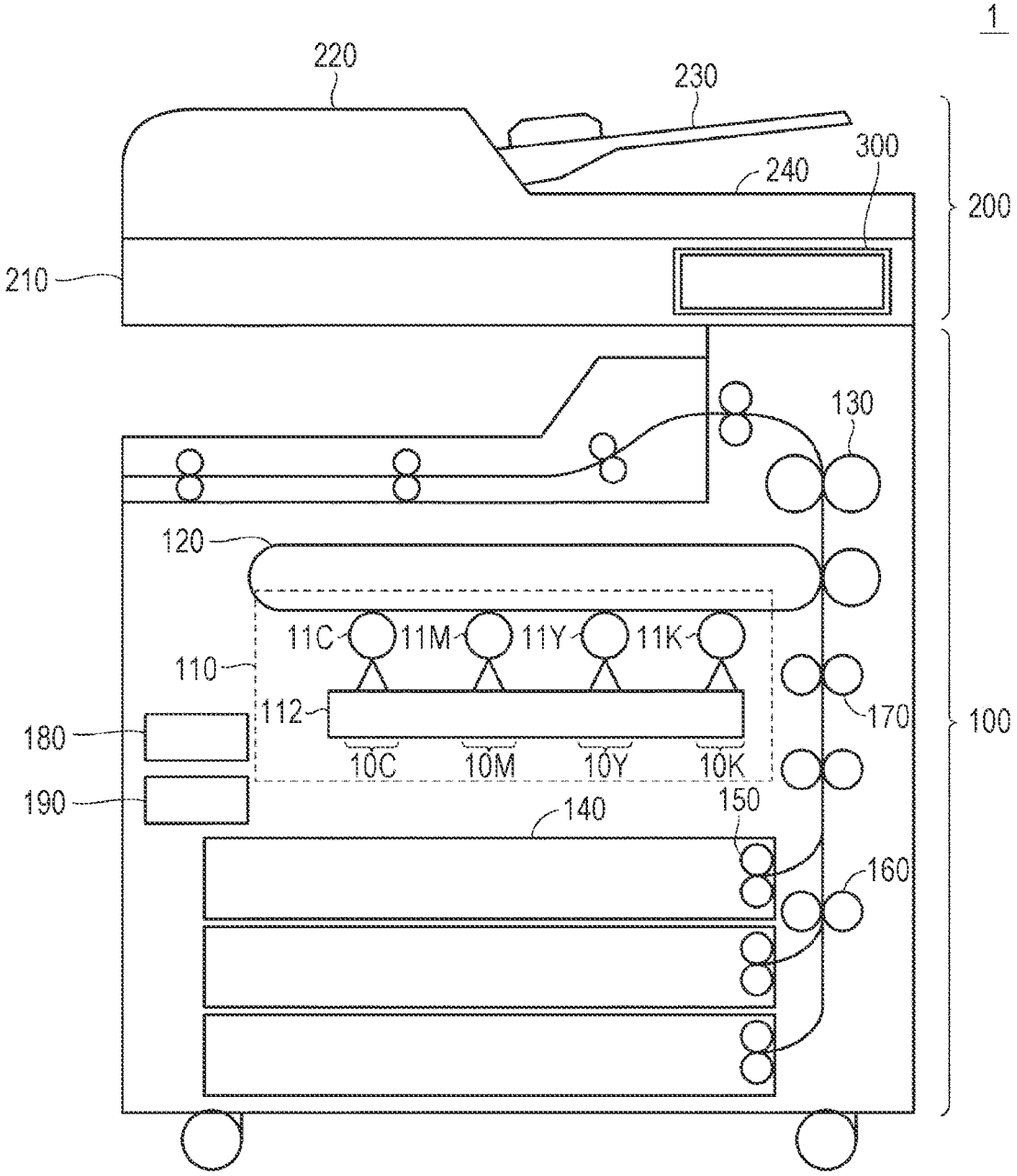
FIG. 1 is a diagram showing an example of an image forming apparatus according to the present embodiment.

Hereinafter, one or more embodiments of the present invention will be described with reference to the drawings. However, the scope of the invention is not limited to the disclosed embodiments. In the following description, the same components are denoted by the same reference numerals. Their names and functions are also the same. Therefore, detailed descriptions thereof will not be repeated.

<A. Overview of Image Forming Apparatus>

FIG. 1 is a diagram showing an example of an image forming apparatus 1 according to the present embodiment. According to the present embodiment, there is provided the image forming apparatus 1 that suppresses light emission control over a light emission element when a light emission controller receives a signal including a control parameter. The control parameter will be described later.

An overview of a hardware configuration of the image forming apparatus 1 will be described with reference to FIG. 1. The image forming apparatus 1 includes a print engine 100, a reader 200, and an operation panel 300.

The print engine 100 includes an imaging unit 110, an intermediate transfer belt 120, a fixer 130, a paper feeder 140, sending rollers 150, delivery rollers 160, resist rollers 170, a controller 180, and a power supplier 190.

The print engine 100 performs print processing on a sheet in the paper feeder 140. The sending rollers 150 deliver the sheet from the paper feeder 140. The delivery rollers 160 deliver the sheet toward the intermediate transfer belt 120.

The imaging unit 110 includes imaging units 10C, 10M, 10Y, and 10K that form toner images of cyan (C), magenta (M), yellow (Y), and key plate (K), respectively. Each of the imaging units 10C, 10M, 10Y, and 10K includes a charger (not illustrated), a developer (not illustrated), a cleaner (not illustrated), and an intermediate transfer body contact roller (not illustrated).

The imaging unit 10C includes a photoreceptor 11C. The imaging unit 10M includes a photoreceptor 11M. The imaging unit 10Y includes a photoreceptor 11Y. The imaging unit 10K includes a photoreceptor 11K. Hereinafter, the photoreceptor 11C, the photoreceptor 11M, the photoreceptor 11Y, and the photoreceptor 11K may be collectively referred to simply as photoreceptors.

An exposer 112 is common to the imaging units 10C, 10M, 10Y, and 10K in one aspect, each of the imaging units 10C, 10M, 10Y, and 10K may include an individual exposer 112. In the following description, it is assumed that the exposer 112 is common to the imaging units 10C, 10M, 10Y, and 10K.

The imaging unit 110 and the intermediate transfer belt 120 form a toner image to be transferred onto the sheet. The charger uniformly charges surfaces of the photoreceptors. The exposer 112 forms an electrostatic latent image on the surfaces of the photoreceptors by exposing the surfaces of the photoreceptors with laser writing or the like, according to a designated image pattern. The developer develops the electrostatic latent image formed on a photoreceptor as a toner image.

The resist rollers 170 adjust a timing of delivering the sheet before the intermediate transfer belt 120. The intermediate transfer belt 120 transfers a toner image onto the sheet. The fixer 130 performs fixing processing on the sheet. Finally, the sheet is ejected to an ejection tray.

A toner image formed on a surface of a photoreceptor is transferred onto the intermediate transfer belt 120 by the intermediate transfer body contact roller. On the intermediate transfer belt 120, toner images are sequentially transferred from the respective photoreceptors, and toner images in the four colors are superimposed. The superimposed toner image is transferred from the intermediate transfer belt 120 onto a sheet.

The reader 200 reads a sheet and outputs a read result to the print engine 100 as an input image. An image scanner 210 scans a sheet placed on platen glass and transmits generated image data to the controller 180. An automatic document feeder 220 continually scans sheets placed on a paper feed table 230.

The sheets placed on the paper feed table 230 are sent one by one by a sending roller (not illustrated), and sequentially scanned by an image sensor disposed in the image scanner 210 or the automatic document feeder 220. The scanned sheets are ejected to a paper ejection table 240.

The controller 180 controls an entire image forming apparatus 1. The power supplier 190 is connected to an alternating current (AC) power source and supplies power to the image forming apparatus 1. The power supplier 190 includes a rectifier circuit therein, and may convert AC supplied from the AC power source into direct current (DC) and supply the DC current to one or all of circuits in the image forming apparatus 1.

The operation panel 300 includes a display (not illustrated) and an operation unit (not illustrated). The display includes a liquid crystal monitor, an organic electro luminescence (EL) monitor, or the like. The liquid crystal monitor, the organic EL monitor, or the like includes a touch sensor, and can display an operation menu and receive input by a touch by a user. The operation unit includes a plurality of buttons, and can receive input from the user, similarly to the touch panel. The operation panel 300 transmits the received input to the controller 180.

Figure 2:
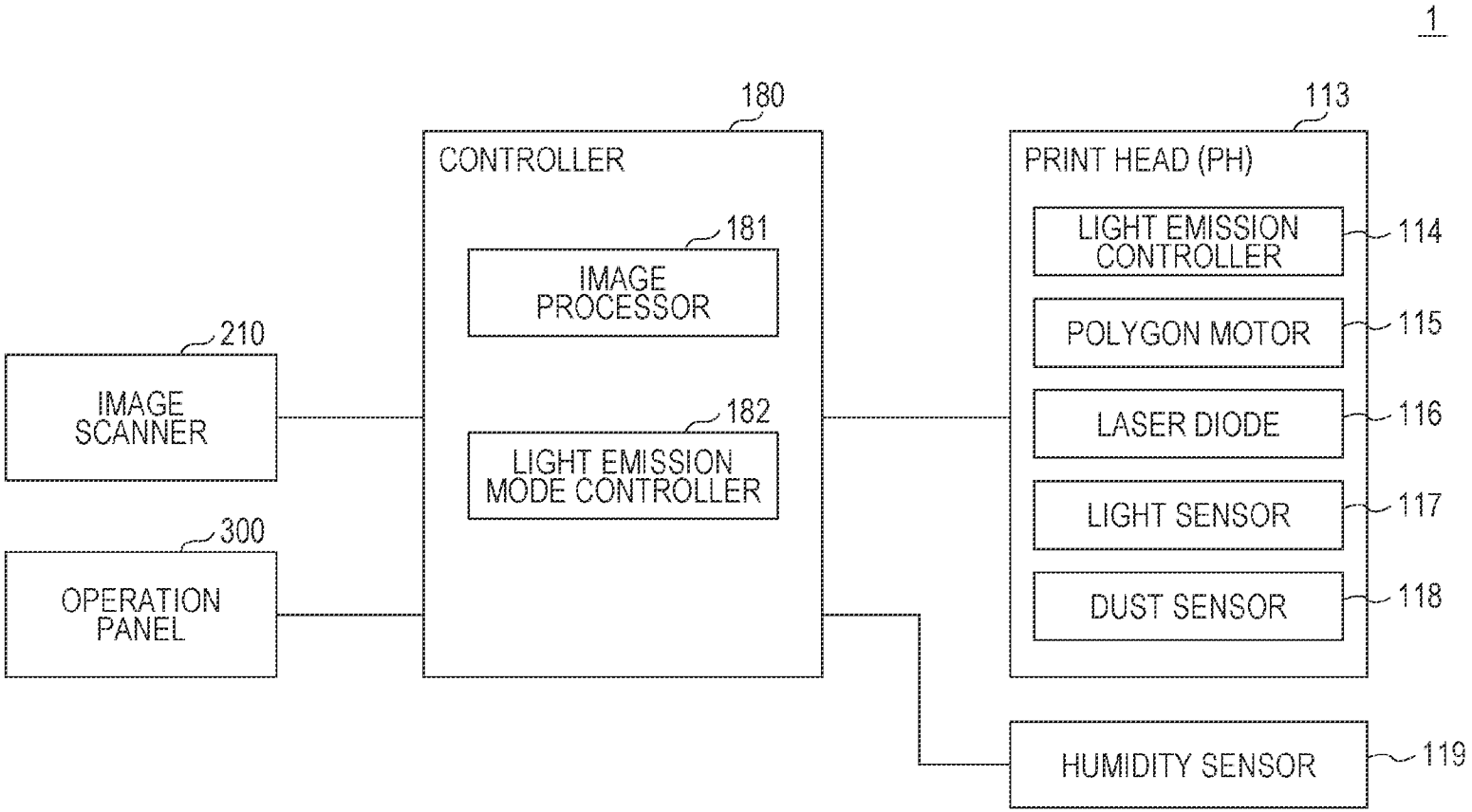
FIG. 2 is a schematic diagram showing an example of a part of a control system related to light emission control of the image forming apparatus.

FIG. 2 is a schematic diagram showing an example of a part of a control system related to light emission control of the image forming apparatus 1. Each of configurations shown in FIG. 2 may be implemented by an electric circuit and hardware used in combination with the electric circuit.

The controller 180 includes an image processor 181 and a light emission mode controller 182. The controller 180 is connected to a print head 113, the image scanner 210, the operation panel 300, and a humidity sensor 119.

The print head 113 includes a light emission controller 114, a polygon motor 115, a laser diode 116, a light sensor 117, and a dust sensor 118.

The controller 180 includes a central processing unit (CPU) (not illustrated), a random access memory (RAM) (not illustrated), and a read only memory (ROM) (not illustrated). The CPU executes or refers to various programs and data loaded in the RAM.

In one aspect, the CPU may be a built-in CPU, a field-programmable gate array (FPGA), a combination thereof, or the like. The CPU may execute a program for implementing various functions of the image forming apparatus 1.

The RAM stores a program executed by the CPU and data referred to by the CPU. In one aspect, the RAM may be implemented by a dynamic random access memory (DRAM) or a static random access memory (SRAM).

The ROM is a non-volatile memory, and may store a program executed by the CPU. In that case, the CPU executes the program loaded from the ROM into the RAM. In one aspect, the ROM may be implemented by an erasable programmable read only memory (EPROM), an electrically erasable programmable read only memory (EEPROM), or a flash memory.

The image processor 181 transmits an image signal to the light emission controller 114. The image signal may be generated on the basis of image data read by the image scanner 210 or image data acquired from an external device via a communicator (not illustrated) included in the image forming apparatus 1. The light emission controller 114 causes the laser diode 116 to form an electrostatic latent image on the surfaces of the photoreceptors on the basis of the image signal.

The light emission mode controller 182 transmits, to the light emission controller 114, information about synchronous light emission for obtaining a start of scan (SOS) signal and information about sample hold (SH) light emission for adjusting an amount of light of the laser diode 116. The SOS signal is a horizontal synchronization signal for an exposure timing of the laser diode 116 that is a light emission element. These pieces of information include a counter value for defining a generation timing, end timing, or the like of each signal.

An SOS signal may be used to determine a start timing of light emission. The SOS signal is generated when the light sensor 117 detects synchronous light emission (hereinafter, referred to as "SOS light emission") for obtaining the SOS signal.

SH light emission is light emission for adjusting an amount of light emitted to the photoreceptors. The light sensor 117 detects SH light emission and transmits a signal based on a detection value to the light emission controller 114 or the controller 180. The light emission controller 114 or the controller 180 may correct the amount of light of the laser diode 116 on the basis of the detection value of the SH light emission.

In one aspect, the image forming apparatus 1 may include a light sensor (not illustrated) that detects backlight of the laser diode 116 provided separately from the light sensor 117.

In the present embodiment, the light emission controller 114 controls SOS light emission and SH light emission with respect to the laser diode 116. In one aspect, adjustment light emission for adjusting light emission control of the laser diode 116 may include light emission other than the SOS light emission and the SH light emission. The execution of the light emission control means that the light emission controller 114 causes the laser diode 116 to emit light.

In one aspect, the image processor 181 and the light emission mode controller 182 may be implemented as individual hardware included in the controller 180. In another aspect, the image processor 181 and the light emission mode controller 182 may be implemented as a program executed by the CPU of the controller 180.

The light emission controller 114 controls each hardware, such as the polygon motor 115 or laser diode 116, in the print head 113. The polygon motor 115 is a motor for driving a polygon mirror for reflecting laser emitted by the laser diode 116.

The laser diode 116 emits laser onto the photoreceptors and forms an electrostatic latent image on the surfaces of the photoreceptors. The light emission controller 114 may emit laser on any place on the surfaces of the photoreceptors of the respective colors by controlling the polygon motor 115 and the laser diode 116.

The light sensor 117 detects laser light emitted from laser diode 116. The light sensor 117 transmits a signal indicating a detected amount of light to the light emission controller 114. In one aspect, light sensor 117 may detect laser light reflected by the polygon mirror.

The dust sensor 118 detects dust around the print head 113. The dust sensor 118 transmits a signal indicating a detected amount of dust to the light emission controller 114. In one aspect, the light emission controller 114 may output an error to the controller 180 in a case where the amount of dust is equal to or greater than a certain value.

The humidity sensor 119 may be provided inside or outside a housing of the image forming apparatus 1. The humidity sensor 119 detects humidity around the humidity sensor 119. The humidity sensor 119 transmits a signal related to the detected humidity to the controller 180. The controller 180 may adjust various parameters for a charging process, exposure process, development process, or the like, for the photoreceptors according to humidity. The various parameters include charged voltage, an amount of light, an amount of toner, or the like.

<B. Light Emission Control and Communication for Light Emission Control>

Figure 3:
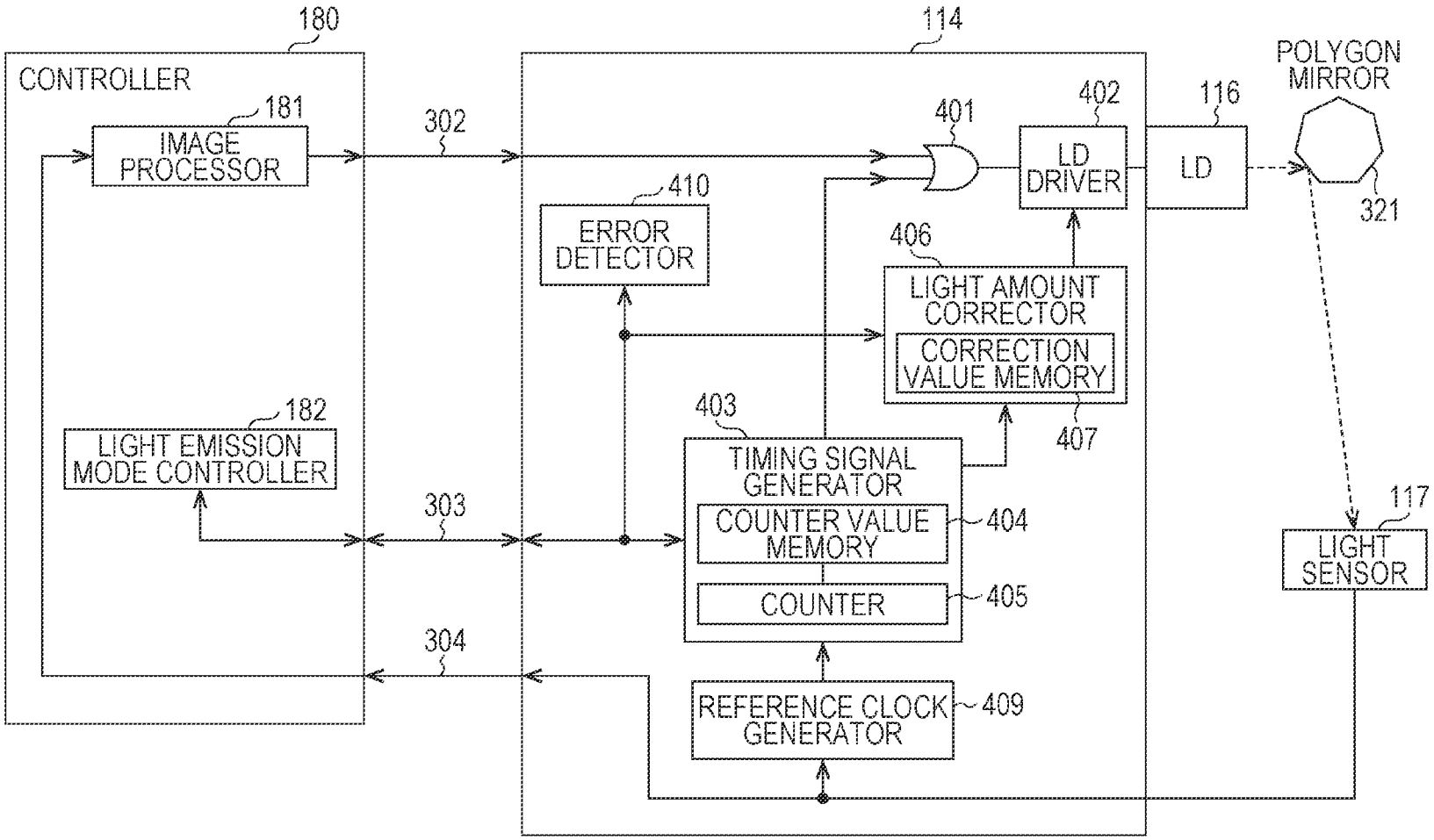
FIG. 3 is a schematic diagram showing an example of a configuration for controlling a laser diode in a light emission controller.

FIG. 3 is a schematic diagram showing an example of a configuration for controlling the laser diode 116 in the light emission controller 114. An internal configuration of the light emission controller 114, light emission control by the light emission controller 114, and communication between the controller 180 and the light emission controller 114 will be described with reference to FIG. 3.

(B-1. Configuration of Light Emission Controller 114)

The light emission controller 114 includes an OR circuit 401, a laser diode driver 402, laser diode 116, a timing signal generator 403, a light amount corrector 406, a reference clock generator 409, and an error detector 410.

The timing signal generator 403 includes a counter value memory 404 and a counter 405. The light amount corrector 406 includes a correction value memory 407. The controller 180 and the light emission controller 114 are connected via an image signal line 302, a serial signal line 303, and an SOS signal line 304.

The OR circuit 401 receives two input signals and outputs one output signal. A first input signal is an image signal output from the image processor 181 via the image signal line 302. A second input signal is a timing signal output from the timing signal generator 403.

If having received input of an image signal, the OR circuit 401 outputs the same signal as the image signal to the laser diode driver 402. If having received input of a timing signal, the OR circuit 401 outputs the same signal as the timing signal to the laser diode driver 402.

The laser diode driver 402 drives the laser diode 116 on the basis of a signal output from the OR circuit 401. For example, if having received an image signal, the laser diode driver 402 controls the laser diode 116 to form, on the surfaces of the photoreceptors, an electrostatic latent image based on the image signal.

If having received a timing signal, the laser diode driver 402 controls the laser diode 116 to execute SOS light emission or SH light emission. A path of laser light output from the laser diode 116 is adjusted by a polygon mirror 321.

The timing signal generator 403 measures a timing of executing the SOS light emission or SH light emission, and outputs a timing signal to the OR circuit 401 in accordance with the timing of executing the SOS light emission or the SH light emission. The counter value memory 404 retains a counter value of each signal.

For example, the counter value memory 404 retains a matching setting of each signal in a timer, a reset timing of the timer, or the like. The counter 405 is a counter for the timer. The timing signal generator 403 counts up or counts down a count value of the counter 405.

The timing signal generator 403 compares the count value of the counter 405 with the count value of the matching setting of each signal in the counter value memory 404, and generates a timing signal in a case where the count values match.

The light emission mode controller 182 transmits a counter value related to the SOS light emission or SH light emission to the light emission controller 114 via the serial signal line 303. In one aspect, these counter values may include a matching setting for SOS light emission, a matching setting for SH light emission, and a reset timing of the timer. The light emission controller 114 saves these received counter values in the counter value memory 404. The controller 180 uses these counter values in order to detect a time period during which a serial communication function is disabled.

The serial signal line 303 may include three signal lines, which are a serial clock signal line, a data input signal line, and a data output signal line. The serial clock signal line sends a clock in serial communication. Data of the serial communication is transmitted or received at a timing of the clock. In one aspect, the controller 180 generates a clock to be transmitted to the serial clock signal line.

The data output signal line sends data from the controller 180 as a master to the light emission controller 114 as a slave. The light emission mode controller 182 transmits data to the light emission controller 114 via the data output signal line.

For example, the light emission mode controller 182 transmits counter values related to SOS light emission and SH light emission to the light emission controller 114 via the data output signal line.

The data input signal line sends data from the light emission controller 114 as the slave to the controller 180 as the master. The light emission mode controller 182 receives data from the light emission controller 114 via the data input signal line.

For example, the light emission controller 114 transmits an ACK signal or the like to the controller 180 via the data output signal line. The ACK signal indicates that the light emission controller 114 has received SOS light emission and SH light emission.

The light amount corrector 406 transmits a light amount correction signal to the laser diode driver 402. The light amount corrector 406 generates a light amount correction signal on the basis of the correction value memory 407. The light amount corrector 406 may store a correction value in the correction value memory 407 on the basis of signals from the light emission mode controller 182 and the timing signal generator 403.

The light emission controller 114 may rewrite the correction value memory 407 on the basis of a signal of a correction value of an amount of light, the signal being acquired from the controller 180 via the serial signal line 303.

The reference clock generator 409 generates a reference clock of a timer used by the timing signal generator 403. The reference clock generator 409 may adjust a start position or end position of the reference dock on the basis of an SOS signal that the light sensor 117 outputs when detecting SOS light emission. The SOS signal is transmitted to the reference clock generator 409 and the controller 180 via the SOS signal line 304.

The error detector 410 detects various errors that occur in the print head 113. Examples of the various errors include overcurrent to the laser diode 116, a voltage drop in the light emission controller 114, a malfunction of the counter 405, and the like.

When the error detector 410 detects these errors, a corresponding bit of a register incorporated in the error detector 410 changes from 0 to 1. The controller 180 reads error information stored in the error detector 410 via the serial signal line 303. More specifically, the controller 180 transmits an error read request to the light emission controller 114 via the serial signal line 303, and receives error information from the light emission controller 114.

(B-2. Generation Timing of Each Light Emission)

Next, a timing at which light emission of the laser diode 116 occurs will be described. As described above, in the exposure process, the print head 113 executes adjustment light emission including SOS light emission and SH light emission, and light emission for forming an electrostatic latent image.

In order to form one image on the surfaces of the photoreceptors, the print head 113 repeats a plurality of times each of the adjustment light emission including SOS light emission and SH light emission, and the light emission for forming an electrostatic latent image. On the surfaces of the photoreceptors, the print head 113 forms a part of the electrostatic latent image in units of lines.

The print head 113 finally forms an electrostatic latent image of one image on the surfaces of the photoreceptors by repeating formation of a part of the electrostatic latent image in units of lines, on the surfaces of the photoreceptors. The adjustment light emission including SOS light emission and SH light emission, and the light emission for forming an electrostatic latent image occur in units of lines. That is, the light emission controller 114 controls SOS light emission and SH light emission during processing of forming a toner image on the photoreceptors.

For example, in a case where the print head 113 forms on the surfaces of the photoreceptors a part of an electrostatic latent image 1000 times in units of lines, the adjustment light emission including SOS light emission and SH light emission, and the light emission for forming an electrostatic latent image also occur 1000 times. The print head 113 repeatedly executes each light emission in an order of light emission for forming an electrostatic latent image, SOS light emission, and SH light emission.

The laser diode 116 performs the adjustment light emission including SOS light emission and SH light emission even during erasure light emission in end sequence processing. The end sequence processing is post-processing in a job, in which an electric potential of the photoreceptors is equalized.

(B-3. Communication That Occurs Between Controller 180 and Light Emission Controller 114)

Communication related to light emission control that occurs between the above-described controller 180 and light emission controller 114 includes at least first communication to fourth communication described below.

In the first communication, the light emission controller 114 performs communication related to a signal including a control parameter for controlling the laser diode 116. The control parameter includes communication of counter values related to SOS light emission and SH light emission. The counter values are counter values for the light emission controller 114 to obtain light emission timings of SOS light emission and SH light emission of the laser diode 116.

The first communication is executed via the serial signal line 303. The light emission controller 114 may count the timing of the adjustment light emission including SOS light emission and SH light emission by rewriting the counter value memory 404 in the timing signal generator 403 on the basis of the first communication. Before and after the light emission for forming an electrostatic latent image on the surfaces of the photoreceptors, the print head 113 executes the adjustment light emission including SOS light emission and SH light emission.

In addition, the control parameter includes an amount of light of the laser diode 116, and a start timing and end timing of light emission of the laser diode 116. The amount of light of the laser diode 116 is an amount of light determined on the basis of feedback from SH light emission. The laser diode 116 emits light on the basis of an amount of light included in the control parameter.

The start timing and end timing of light emission of the laser diode 116 indicate a timing at which the laser diode 116 emits light at first of an entire job and the timing at which the laser diode 116 emits light at last in the entire job.

The second communication is communication of an image signal. The controller 180 transmits an image signal to the light emission controller 114 on the basis of having acquired image data and a print command. The image signal is a signal for causing the print head 113 to form an electrostatic latent image on the surfaces of the photoreceptors. The light emission controller 114 executes light emission for forming an electrostatic latent image on the surfaces of the photoreceptors on the basis of the second communication.

The third communication is communication of a detection value of light sensor 117. The light sensor 117 detects laser light of the laser diode 116. After detecting the laser light, light sensor 117 transmits a detection signal to the reference clock generator 409 and the controller 180 via the SOS signal line 304.

The detection signal transmitted from the light sensor 117 may include at least an SOS signal. The reference clock generator 409 may adjust a reference clock on the basis of an SOS signal at the time of detecting SOS light emission.

The fourth communication is communication for a transmission request related to an error in the light emission controller 114. The fourth communication occurs for reading error information. The controller 180 communicates with the light emission controller 114 via the serial signal line 303 in order to read error information in the error detector 410. The fourth communication may be performed immediately after the first communication.

In a case where the first communication and the fourth communication (serial communication) among the above-described four communications have occurred, the light emission controller 114 operates a large number of flip-flop circuits in order to rewrite incorporated register memories for serial communication all at once. As a result, the light emission controller 114 temporarily consumes a large amount of power.

Simultaneous occurrence of serial communication and light emission control may cause a voltage drop in the light emission controller 114, resulting in malfunction of the counter 405, or the like. When a malfunction of the counter 405 occurs, an electrostatic latent image may not be properly formed on the surfaces of the photoreceptors, and quality of a printed image may be deteriorated.

(B-4. Timing at Which Light Emission Control and Serial Communication Occur Simultaneously)

Next, an example of a timing at which light emission control and serial communication may occur simultaneously will be described. The first communication occurs in response to the controller 180 receiving a job. By the first communication, the print head 113 receives data related to a setting of a job or the like.

The first communication occurs, for example, before switching to a stabilization mode that is a mode for adjusting a state of a toner image.

In addition, the first communication occurs before inter-paper patch processing that is processing for adjusting a state of the photoreceptors. The inter-paper patch processing is processing of performing test patch processing on the photoreceptors between jobs to adjust friction of entire photoreceptors to be even. The image forming apparatus 1 adjusts a state of the photoreceptors with the inter-paper patch processing.

The first communication also occurs before black-and-white print processing is switched to color print processing. The first communication also occurs before color print processing is switched to black-and-white print processing.

For example, the controller 180 causes the first communication to occur in order to operate all the imaging units 10C, 10M, 10Y, and 10K, switching from a state where only the imaging unit 10K is operated for forming a timer image with key plate.

In an image forming apparatus 1 including a full-color print function, the print head 113 includes light emission elements (laser diodes 116) for the respective colors of yellow (Y), magenta (M), cyan (C), and key plate (black) (K). When switching from the black-and-white print processing to the color print processing, the image forming apparatus 1 switches the light emission element (laser diode 116) for each of the colors.

For example, when switching from the black-and-white print processing to the color print processing, the image forming apparatus 1 switches from the black-and-white print processing that causes the light emission element corresponding to the key plate (black) (K) alone to emit light to the color print processing that causes the all the light emission elements to emit light. When switching from the color print processing to the black-and-white print processing, the image forming apparatus 1 switches from the color print processing that causes all the light emission elements to emit light to the black-and-white print processing that causes the light emission element corresponding to the key plate (black) (K) alone to emit light.

The image forming apparatus 1 causes the first communication to occur before switching a light emission element subjected to light emission control. The image forming apparatus 1 may switch a light emission element subjected to light emission control not only when switching between black-and-white and color, but also, for example, when detecting an error in one of the plurality of the light emission elements.

The first communication may occur before performing end sequence processing for equalizing an electric potential of the above-described photoreceptors.

In the image forming apparatus 1, the inter-paper patch processing, the end sequence processing, processing of switching to the stabilization mode, and processing of switching between the black-and-white print processing and the color print processing are executed.

During the inter-paper patch processing, the laser diode 116 emits light in a light emission manner different from a light emission manner at a lime of normal print processing. Hereinafter, the light emission manner of the laser diode 116 during the inter-paper patch processing may be referred to as light emission in an inter-paper patch mode.

In the end sequence processing also, the laser diode 116 emits light in an end sequence mode different from a light emission manner at a time of normal print processing and the light emission manner in the inter-paper patch mode. The laser diode 116 emits light in different unique light emission manners in the stabilization mode, a black-and-white print processing mode, and a color print processing mode. Hereinafter, each of these unique light emission manners is referred to as a light emission mode of a laser diode 116.

Thus, by the light emission controller 114 receiving a signal including the control parameter from the controller 180, a plurality of light emission modes of different light emission manners is set to the laser diode 116.

After the first communication, the print head 113 emits light to form an electrostatic latent image. In addition, immediately after the first communication, the fourth communication may occur.

Therefore, while the light emission controller 114 is controlling light emission, the image forming apparatus 1 according to the present embodiment disables a serial communication function of the controller 180 so that serial communication, which may occur simultaneously with light emission control as described above, does not occur.

The controller 180 executes serial communication exclusively when the light emission controller 114 is not controlling light emission. For example, the controller 180 executes the fourth communication for reading error information in the error detector 410 exclusively when the light emission controller 114 is not controlling light emission, such as after completion of light emission control.

More specifically, the light emission mode controller 182 generates counter values related to SOS light emission and SH light emission, and transmits these counter values to the light emission controller 114. Thus, the light emission mode controller 182 can detect a timing at which the light emission controller 114 completes light emission control (light emission of a light emission element completes) on the basis of the counter values related to SOS light emission and SH light emission.

The controller 180 may prohibit occurrence of serial communication to the light emission controller 114 from a start timing to completion timing of light emission control by the light emission controller 114 (from start to completion of light emission of a light emission element) to prevent the above-described voltage drop.

In another aspect, by disabling functions of a serial clock port, a data input port, and a data output port, the controller 180 may prohibit serial communication from start to completion of light emission of a light emission element.

The image forming apparatus 1 according to the present embodiment disables the serial communication function of the controller 180 during light emission control on the basis of various counter values set to the light emission controller 114.

With the function, the image forming apparatus 1 prevents simultaneous occurrence of serial communication and light emission control. As a result, in the light emission controller 114, a voltage drop does not occur, a malfunction of the counter 405 due to the voltage drop does not occur, and quality of an image to be printed is improved.

<C. Hardware Configuration of Print Head>

Figure 4:
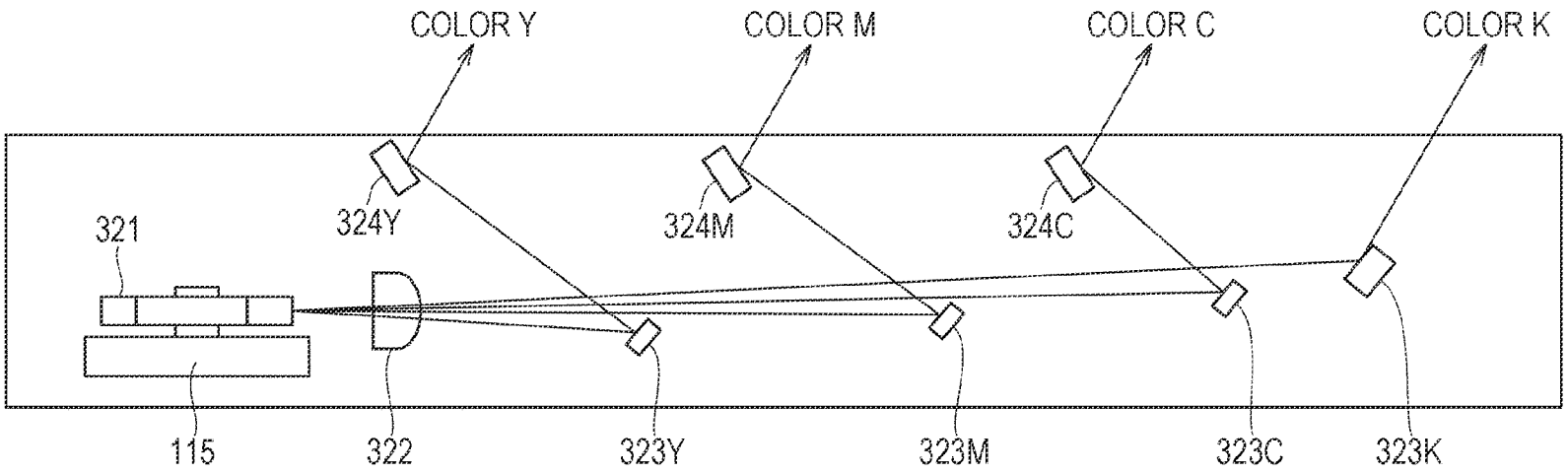
FIG. 4 is a side view showing an example of a configuration of a print head.

Next, reflection of laser light in the print head 113 will be described with reference to FIGS. 4 and 5. FIG. 4 is a side view showing an example of a configuration of the print head 113. In the example shown in FIG. 4, laser light reflected by the polygon mirror 321 enters a reflection mirror for reflecting laser light on the photoreceptors of the respective colors via an fθ lens 322.

Reflection mirrors 323Y and 324Y reflect laser light to an yellow photoreceptor. Reflection mirrors 323M and 324M reflect laser light to a magenta photoreceptor. Reflection mirrors 323C and 324C reflect laser light to a cyan photoreceptor. A reflection mirror 323K reflects laser light to a key plate (black) photoreceptor.

Figure 5:
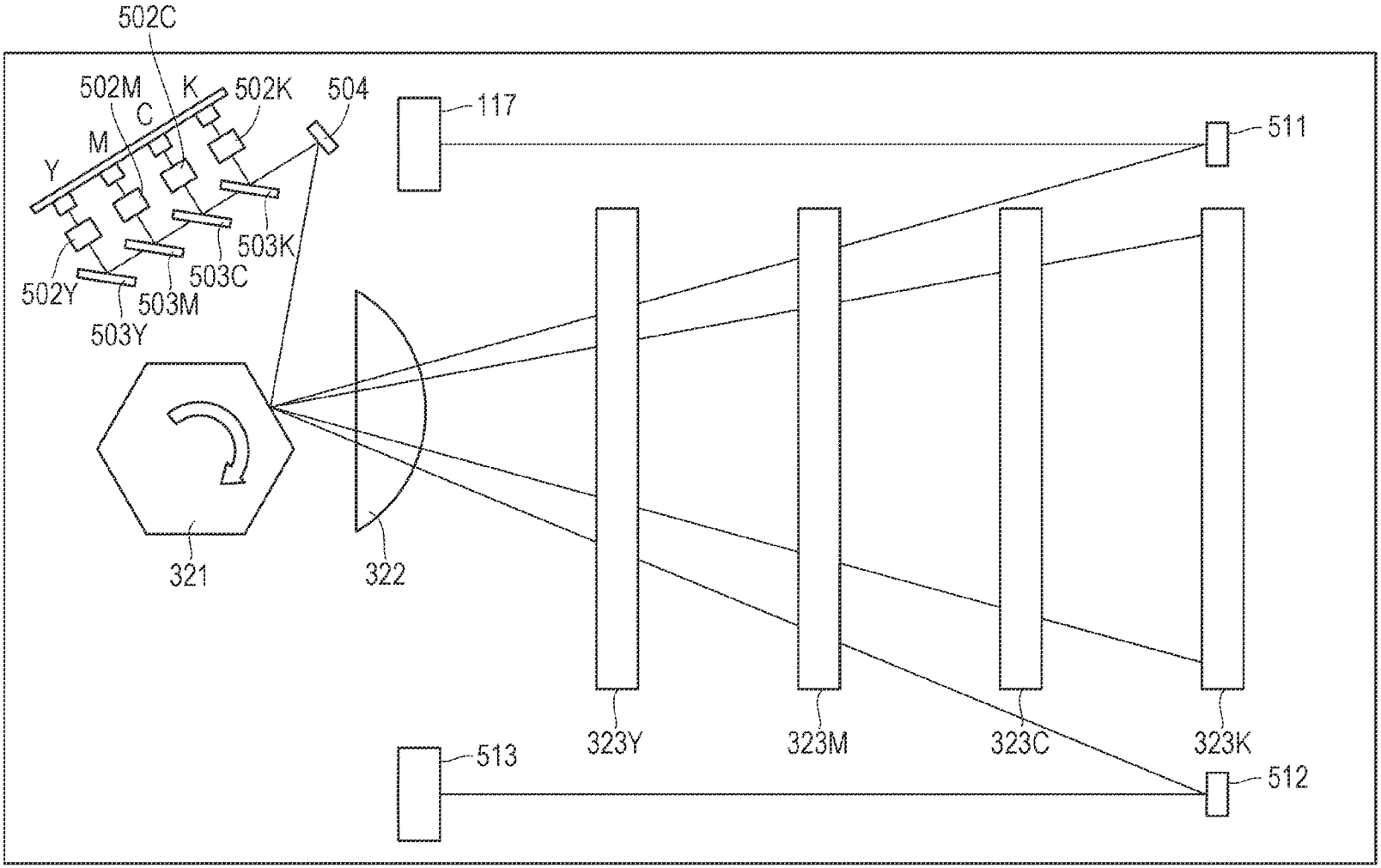
FIG. 5 is a top view showing an example of the configuration of the print head.

FIG. 5 is a top view showing an example of the configuration of the print head 113. In an image forming apparatus 1 including a full-color print function, the print head 113 includes light emission elements (laser diodes 116) for the respective colors of yellow (Y), magenta (M), cyan (C), and key plate (black) (K).

Laser light emitted from each of the light emission elements is condensed by each of collimator lenses 502Y, 502M, 502C, and 502K. Each of the condensed laser lights is collected onto a reflection mirror 504 by each of reflection mirrors 503Y, 503M, 503C, and 503K, which are provided with steps. The reflection mirror 504 guides each of the laser lights to the polygon mirror 321. A portion of the laser light reflected from the polygon mirror 321 enters the light sensor 117 via a reflection mirror 511. By the laser light entering the light sensor 117, the controller 180 detects a synchronization signal including an SOS signal of the laser light reflected by the polygon mirror 321.

The image forming apparatus 1 according to the present embodiment further includes a reflection mirror 512 and a light sensor 513. By the laser light entering the light sensor 513, the controller 180 detects an end signal of the laser light reflected by the polygon mirror 321.

<D. Timing of Light Emission and Signal>

Figure 6:
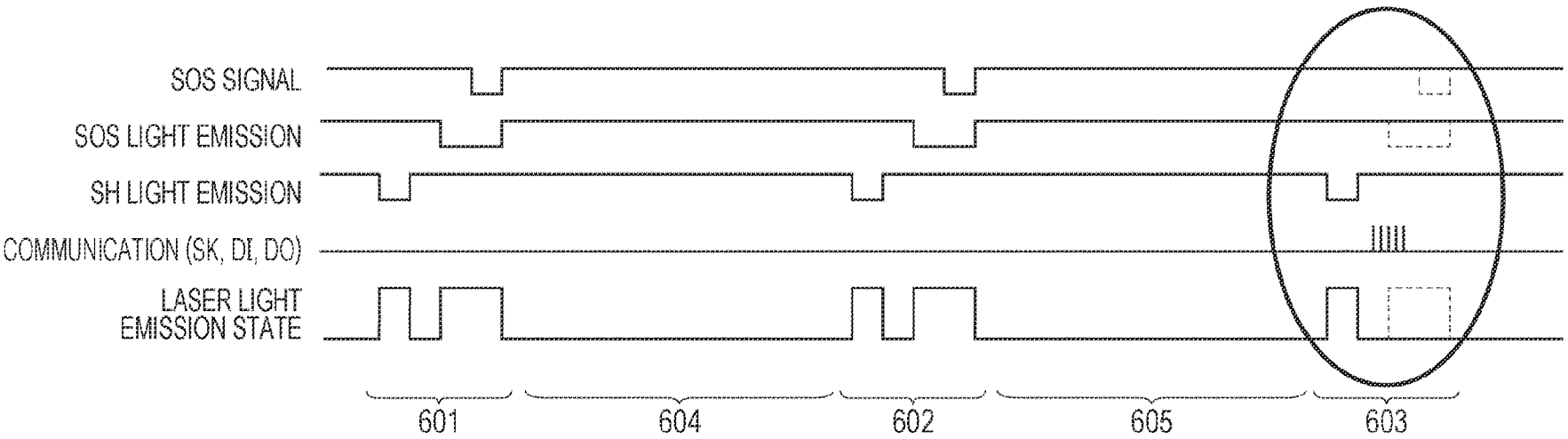
FIG. 6 is a diagram showing an example of each light emission and signal in a case of simultaneous occurrence of a timing of starting adjustment light emission for the laser diode and serial communication.

Next, with reference to FIGS. 6 and 7, a light emission timing of a laser diode 116 and a signal generation timing of serial communication will be described. FIG. 6 is a diagram showing an example of each light emission and signal in a case of simultaneous occurrence of a timing of starting adjustment light emission for the laser diode 116 and serial communication.

Communication (SK, DI, DO) means a serial clock signal, a data input signal, and a data output signal.

The light emission controller 114 controls adjustment light emissions 601, 602, and 603 of three times at a constant cycle. In the present embodiment, adjustment light emission includes SOS light emission and SH light emission. In one aspect, the adjustment light emission may include another light emission.

The light emission controller 114 controls light emission for forming an electrostatic latent image on a surface of a photoreceptor during light emission control of the adjustment light emissions 601, 602, and 603 periodically and continually generated. For example, the light emission controller 114 may control light emission for forming an electrostatic latent image for one line on the surface of the photoreceptor during a time period 604 between adjustment light emission 601 and adjustment light emission 602.

Similarly, the light emission controller 114 may control light emission for forming an electrostatic latent image for one line on the surface of the photoreceptor during a time period 605 between the adjustment light emission 602 and adjustment light emission 603. That is, the second communication occurs during the time period 604 and the time period 605.

In the example shown in FIG. 6, serial communication occurs at a start timing of SOS light emission of third adjustment light emission, which is the adjustment light emission 603. As a result, the processing of rewriting a register for communication in the light emission controller 114 and light emission of the laser diode 116 occur simultaneously, and a voltage drop occurs in the light emission controller 114.

At that time, the counter 405 causes a malfunction, the light emission controller 114 does not execute SOS light emission processing which should originally be executed, and subsequent formation of an electrostatic latent image on the surface of the photoreceptor is skipped. As a result, quality of a printed image is deteriorated. In addition, a malfunction of the counter 405 may shift a timing of light emission of the laser diode 116.

Figure 7:
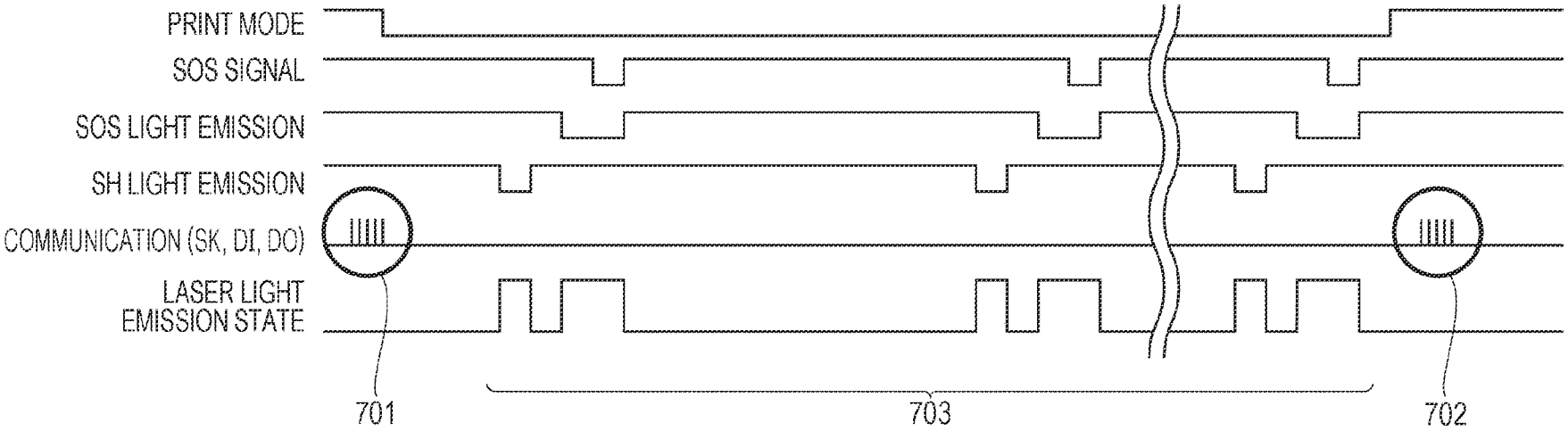
FIG. 7 is a diagram showing an example of each light emission and signal in a case where a disable function of serial communication by a controller is used in a configuration in FIG. 5.

FIG. 7 is a diagram showing an example of each light emission and signal in a case where a disable function of serial communication by the controller 180 is used in a configuration in FIG. 5. A time period 703 is a time period during which the light emission controller 114 controls light emission. In other words, the time period is a time period during which image formation processing is executed by the light emission controller 114.

During the time period 703, the controller 180 disables the serial communication function of the controller 180. Therefore, serial communication 701 and serial communication 702 between the controller 180 and the light emission controller 114 occur exclusively before and after the time period 703. As a result, a voltage drop does not occur in the light emission controller 114, and deterioration in quality of a printed image does not occur.

<E. Light Emission Timing Between Jobs>

Figure 8:
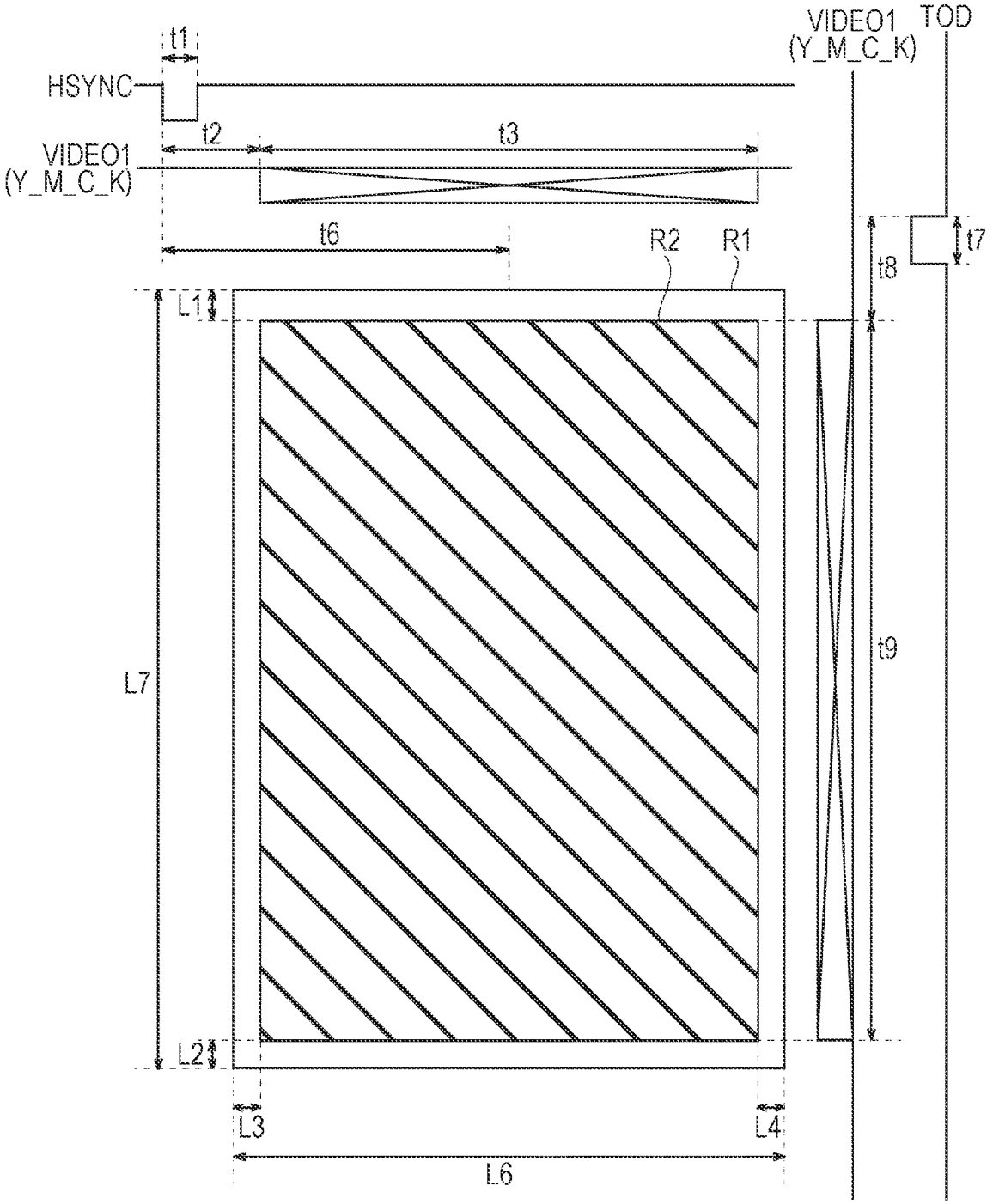
FIG. 8 is a diagram showing timings of various light emissions on one sheet.

FIG. 8 is a diagram showing timings of various light emissions on one sheet. A region R1 is a region indicating one sheet of an A4 size or the like, for example. A width L7 indicates length of a vertical width of the sheet, and a width L6 indicates length of a horizontal width of the sheet.

Of the sheet indicated by the region R1, a region R2 is a region on which image formation processing is performed. That is, a width L1, a width L2, a width L3, and a width L4 indicate a margin region on which the image formation processing is not performed. With this arrangement, the image forming apparatus 1 prevents toner from being fixed to an edge of the sheet, and as a result, prevents the toner from adhering to a back surface of the sheet.

HSYNC means a horizontal synchronization signal. A time period t1 indicates a time period during which SOS light emission, which is light emission for obtaining a horizontal synchronization signal, is performed. TOD means a vertical synchronization signal. A time period t7 indicates a time period during which light emission for obtaining the vertical synchronization signal is performed.

VIDEO1 (Y_M_C_K) means communication of an image signal, which is the second communication. That is, VIDEO1 (Y_M_C_K) means exposure for forming an electrostatic latent image on the photoreceptors.

A time period t3 indicates a time period during which the laser diode 116 emits light in a horizontal direction on the basis of the image signal. A time period t2 indicates a time period from a start of the SOS light emission to a start of light emission based on the image signal. A time period t6 indicates a time period from the SOS light emission to a time when the light emitted on the basis of the image signal reaches a center of the sheet.

A time period t9 indicates a time period during which a laser diode 116 emits light in a vertical direction on one sheet on the basis of the image signal. A time period t8 indicates a time period from a time when the light emission for obtaining the vertical synchronization signal is performed to a time when light emission based on the image signal is first started for the sheet indicated by the region R1.

Figure 9:
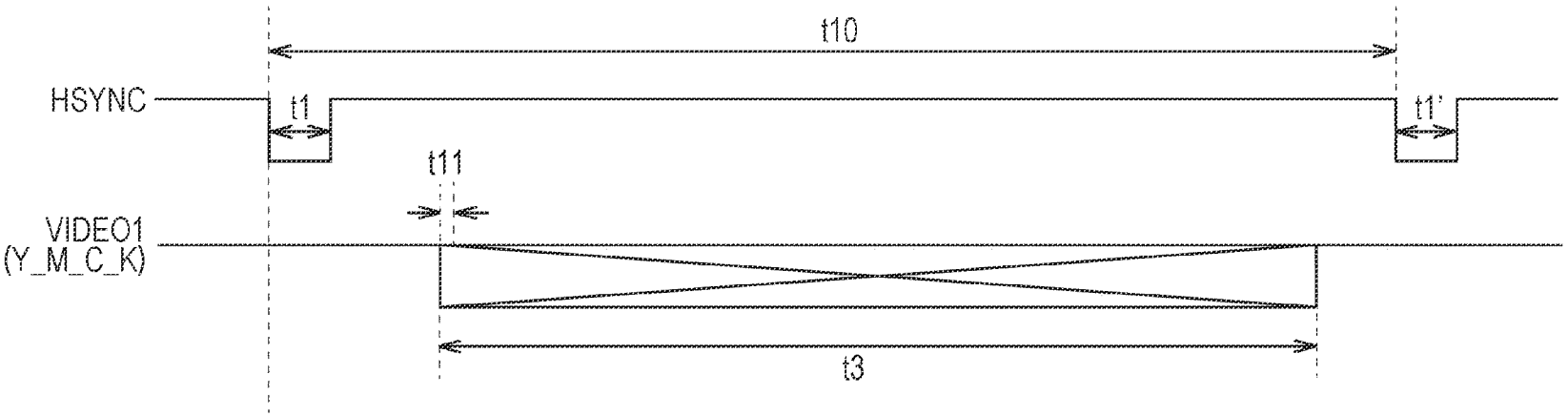
FIG. 9 is a diagram showing that SOS light emission periodically emits light.

FIG. 9 is a diagram showing that SOS light emission is periodically performed. The light emission controller 114 controls SOS light emission in the time period t1 and the time period t1'. First, the light emission controller 114 controls the SOS light emission in the time period t1. Thereafter, in order to expose the photoreceptor on the basis of the image signal, the light emission controller 114 emits light to expose a photoreceptor on the basis of the image signal during the time period t3.

After finishing light emission for exposing the photoreceptor on the basis of the image signal, the light emission controller 114 again controls SOS light emission during the time period t1'. That is, the light emission controller 114 performs light emission control of the SOS light emission for the laser diode 116 in a cycle of a time period t10. A time period t11 is a time period that indicates light emission of one dot in the image signal.

Figure 10:
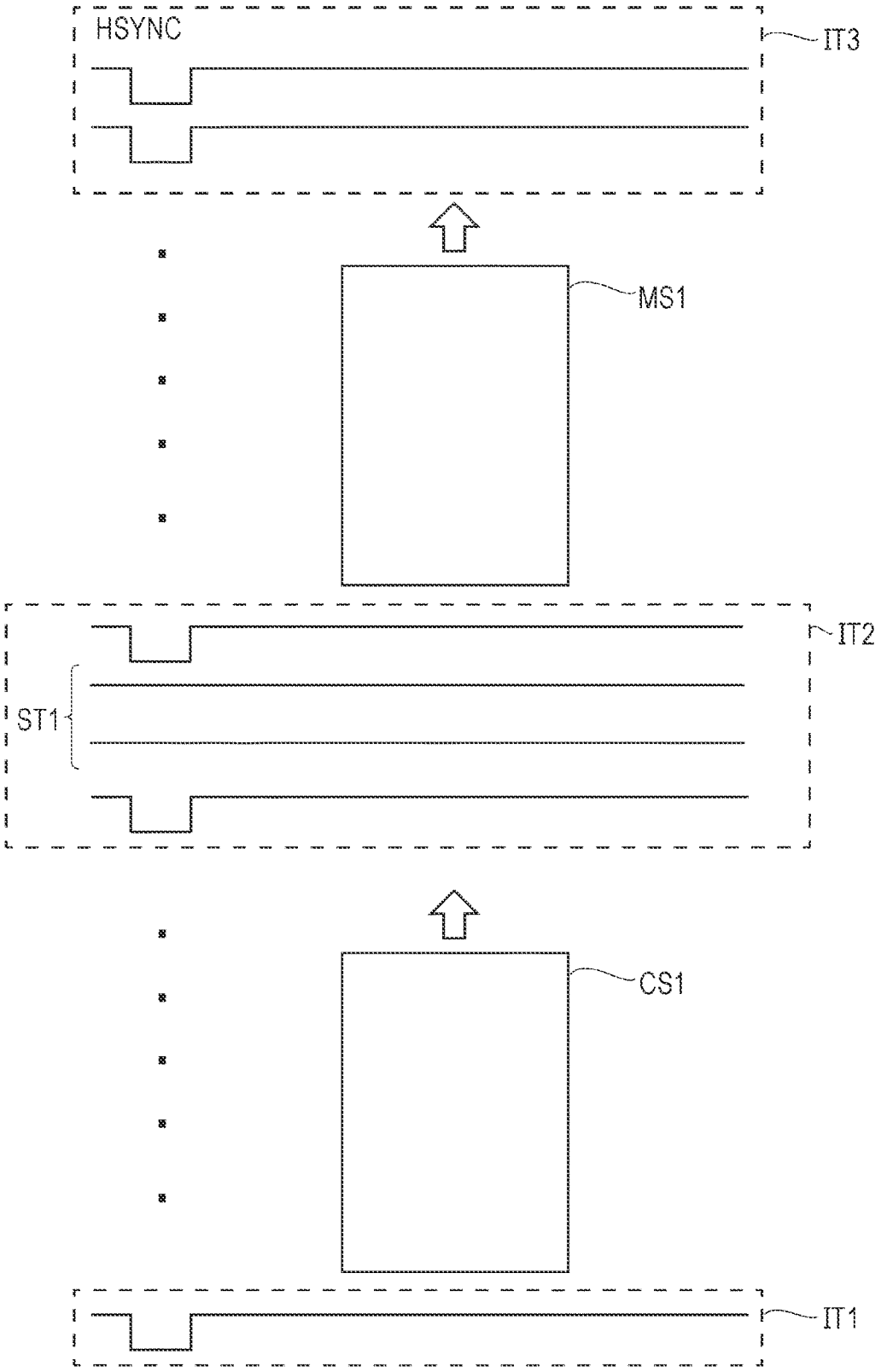
FIG. 10 shows an example of a case where serial communication is performed between jobs.

FIG. 10 shows an example of a case where serial communication is performed between jobs. FIG. 10 shows an example in which print processing of a sheet MS1 is performed after print processing of a sheet CS1 is performed. The sheet CS1 indicates a sheet on which color print processing is performed. The sheet MS1 indicates a sheet on which black-and-white print processing is performed.

A time period IT1 indicates a state of the SOS light emission before print processing of the sheet CS1. A time period IT2 indicates a state of the SOS light emission after completion of the print processing of the sheet CS1 and before a start of the print processing of the sheet MS1. A time period IT3 indicates a state of the SOS light emission after the print processing of the sheet MS1 is indicated. That is in FIG. 10, processing by the image forming apparatus 1 proceeds from a lower side to an upper side in the drawing.

In the time period IT1, a laser diode 116 emits SOS light. The laser diode 116 periodically emits SOS light also during the print processing of the sheet CS1.

The controller 180 performs serial communication to the light emission controller 114 when performing the inter-paper patch processing, the end sequence processing, processing of switching to the stabilization mode, processing of switching between the black-and-white print processing and color print processing, or the like. That is, the first communication occurs.

In an example in FIG. 10, processing of switching from the color print processing to the black-and-white print processing is performed between the print processing of the sheet CS1 and the print processing of the sheet MS1. Therefore, the first communication occurs between the print processing of the sheet CS1 and the print processing of the sheet MS1.

In other words, in the time period IT2, the controller 180 transmits a signal including the control parameter to the light emission controller 114 via serial communication in order to switch from the color print processing to the black-and-white print processing.

The light emission controller 114 stops light emission of the laser diode 116 in the time period ST1 according to communication that receives the signal including the control parameter from the controller 180. That is, the light emission controller 114 stops light emission control over the laser diode 116.

That is, in FIG. 10, the light emission controller 114 stops controlling adjustment light emission with respect to the laser diode 116 when receiving the signal including the control parameter from the controller 180. As indicated by the time period ST1, SOS light emission of the laser diode 116 is stopped by the light emission controller 114 when the signal including the control parameter is received. Thus, the controller 180 is only required to transmit the signal including the control parameter, and the light emission controller 114 can stop the SOS light emission.

The laser diode 116 emits SOS light immediately after a start of the time period IT2, and then stops the SOS light emission in the time period ST1. The controller 180 can transmit the signal including the control parameter in the time period ST1.

Thus, the signal including the control parameter and the SOS light emission do not occur simultaneously in the time period IT2. As a result, a malfunction of the light emission controller 114 and a timing shift of light emission of the laser diode 116 are prevented.

Meanwhile, before transmitting a signal including the control parameter for switching from color print processing to black-and-white print processing, the controller 180 may transmit to the light emission controller 114 a signal that stops light emission of the laser diode 116.

With this arrangement, by the controller 180 previously transmitting to the light emission controller 114 a signal that stops light emission, it is possible to more reliably prevent simultaneous occurrence of the signal including the control parameter and the SOS light emission, before the first communication occurs. As a result, a malfunction of the light emission controller 114 and a timing shift of light emission of the laser diode 116 are prevented.

At a time point when transmission of the signal including the control parameter ends, the controller 180 transmits to the light emission controller 114 a transmission end signal indicating an end of transmission of a signal including the control parameter. The light emission controller 114 starts light emission control over the laser diode 116 in response to the reception of the transmission end signal.

Thus, the light emission controller 114 can start light emission of the laser diode 116 after reading the control parameter and receiving the transmission end signal. That is, the light emission controller 114 starts light emission of the laser diode 116 when completing to read the control parameter received from the controller 180.

In one aspect, instead of transmitting the transmission end signal, the controller 180 may cause the laser diode 116 to start light emission when a predetermined time elapses from a time at which the light emission controller 114 received the signal including the control parameter.

In the example in FIG. 10, SOS light emission starts in the time period IT2 after mode switching processing ends, that is, after the time period ST1 ends. As a result, the image forming apparatus 1 can efficiently start black-and-white print processing, and productivity is improved.

FIG. 10 shows an example in which a timing at which the controller 180 transmits the signal including the control parameter is in a time period during which light emission based on an image signal is not performed. That is, the controller 180 transmits a signal including the control parameter between the print processing of the sheet CS1 and the print processing of the sheet MS1.

As shown in FIG. 7, this is because the image forming apparatus 1 according to the present embodiment prohibits transmission of a signal including a control parameter in the time period 703 during which print processing of a sheet is performed.

In one aspect, the light emission controller 114 may allow transmission of the signal including the control parameter even in the time period 703 during which print processing of a sheet is performed. In this case, in response to having received the signal including the control parameter, the light emission controller 114 also stops light emission based on an image signal to interrupt the print processing, and thereby reads the control parameter.

Figure 11:
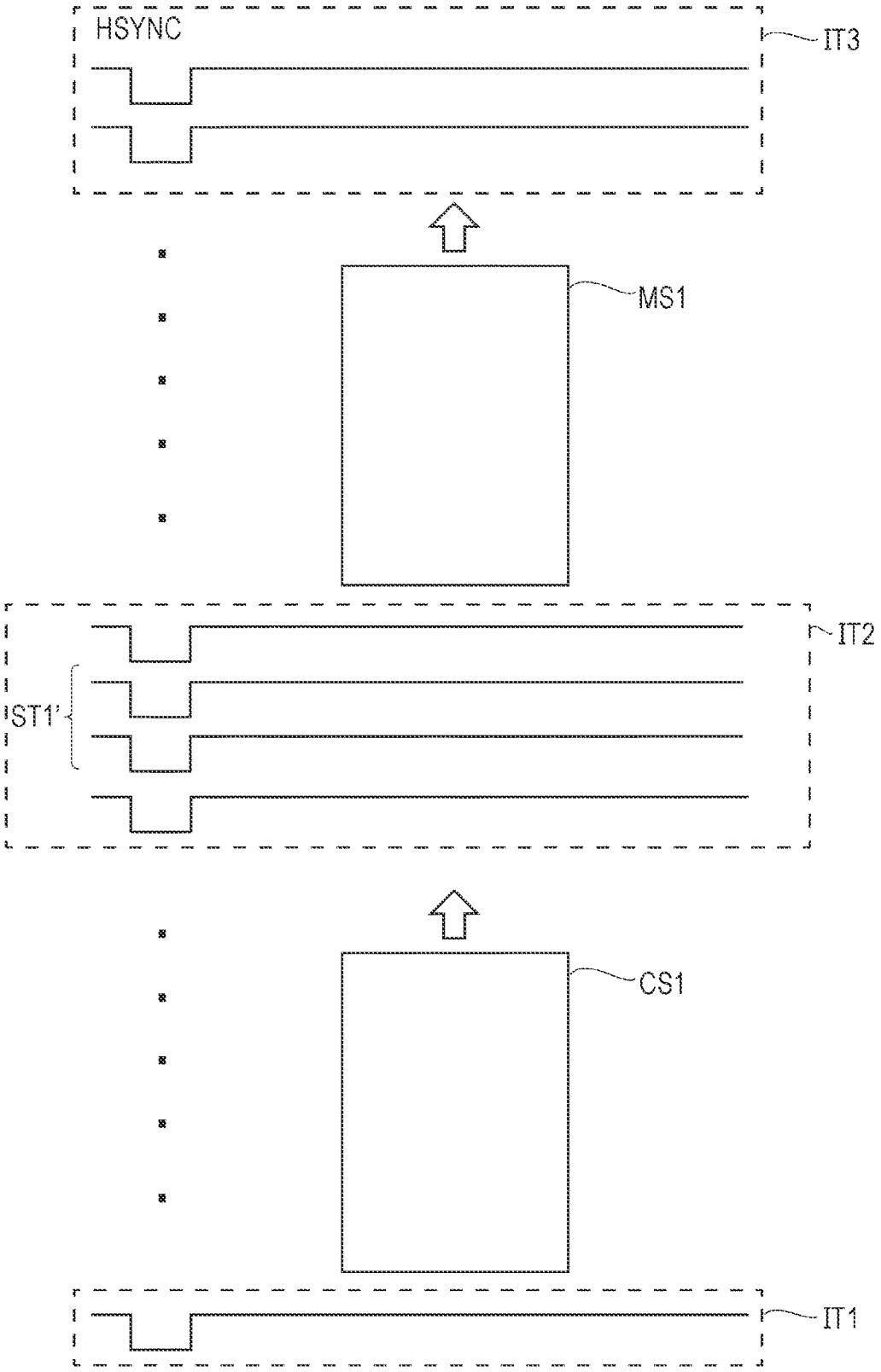
FIG. 11 is a comparative example to FIG. 10.

FIG. 11 is a comparative example to FIG. 10. Description of points common in FIGS. 11 and 10 will not be repeated. In FIG. 11, even when the controller 180 transmits a signal including a control parameter to the light emission controller 114, the light emission controller 114 continues SOS light emission during the time period ST1'.

Thus, a signal including a control parameter and SOS light emission may occur simultaneously in the time period IT2. As a result, a malfunction of the light emission controller 114 and a timing shift of light emission of the laser diode 116 are prevented.

<F. Application to Other Device Configurations>

The above-described disclosure is also applicable to a plurality of light emission controllers 114. A method for controlling serial communication by the controller 180 during light emission control by a plurality of light emission controllers 114 will be described with reference to FIG. 12.

Figure 12:
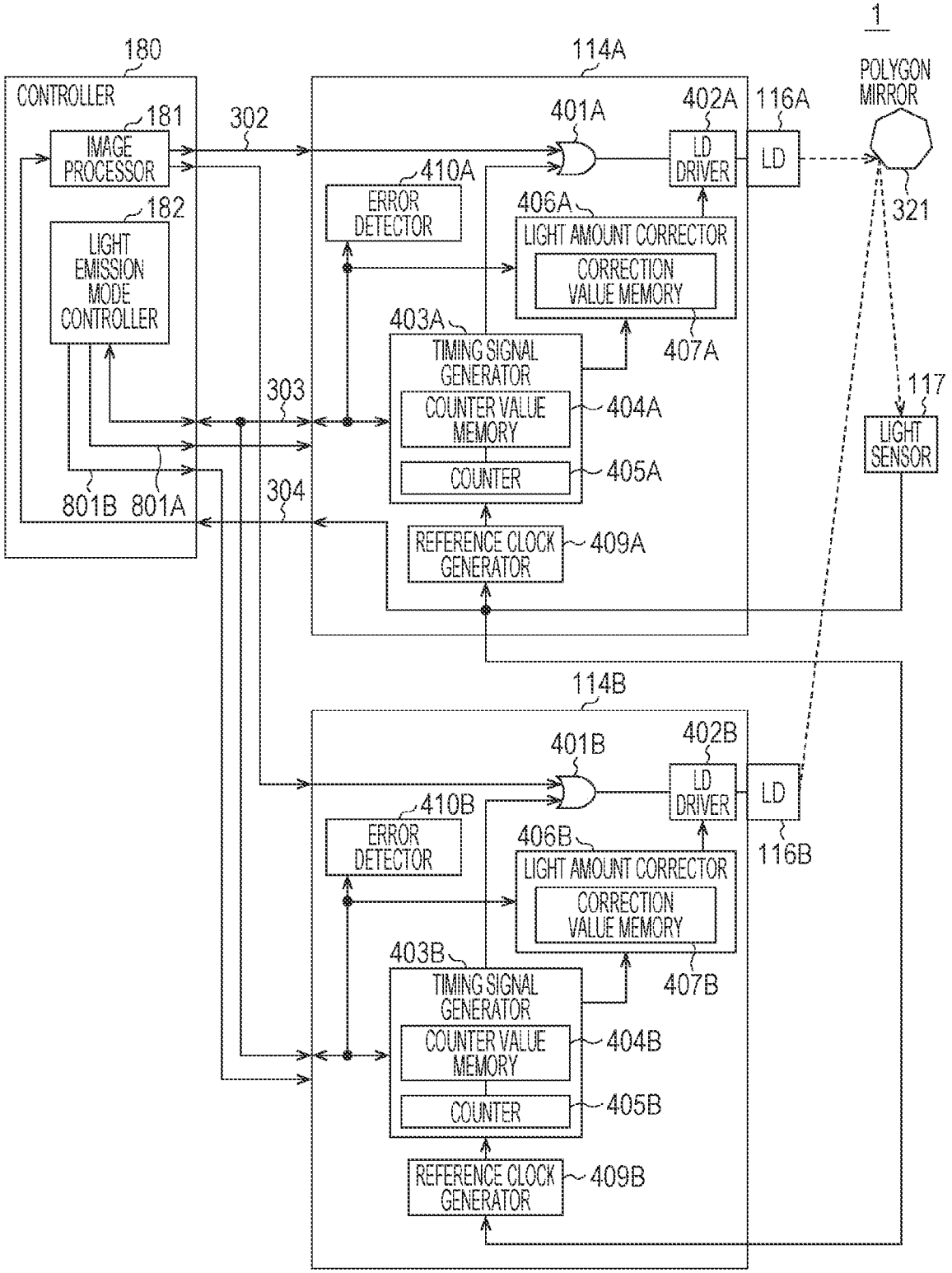
FIG. 12 is a first schematic diagram showing an example of a print head including a plurality of light emission controllers.

FIG. 12 is a first schematic diagram showing an example of the print head 113 including a plurality of light emission controllers 114. An example shown in FIG. 12 is different from the example shown in FIG. 3 in that a plurality of light emission controllers 114A and 114B controls light emission.

For example, the light emission controller 114A may form electrostatic latent images of yellow (Y) and cyan (C), and the light emission controller 114B may form electrostatic latent images of magenta (M) and key plate (black) (K). As described above, by including the plurality of light emission controllers 114A and 114B, the print head 113 may form an electrostatic latent image on a surface of a photoreceptors at high speed.

In the example in FIG. 12, the controller 180 includes at least two select ports (not illustrated) for designating a communication destination of serial communication. A first select port is connected to the light emission controller 114A via a signal line 801A. A second select port is connected to the light emission controller 114B via a signal line 801B.

The controller 180 determines the communication destination by setting output (select signal) of either of the first select port or the second select port to HIGH. For example, in a case where the controller 180 sets output of the first select port to HIGH, the light emission controller 114A decides that the own device has been selected as the communication destination, and acquires a signal transmitted from the controller 180.

Conversely, output of the second select port remains LOW. The light emission controller 114B decides that the own device has not been selected as the communication destination, and does not acquire the signal transmitted from the controller 180.

The controller 180 does not set the select port of the light emission controller 114 during light emission control to HIGH on the basis of a counter value of SOS light emission and SH light emission transmitted to each of the light emission controllers 114A and 114B, and thereby can prevent simultaneous occurrence of light emission processing and serial communication in each of the light emission controllers 114A and 114B.

In one aspect, the controller 180 may implement the above-described functions by conditional branching or the like by software. In another aspect, the controller 180 may rewrite a register of each of the select ports so that output of each of the select ports cannot be set to HIGH.

Figure 13:
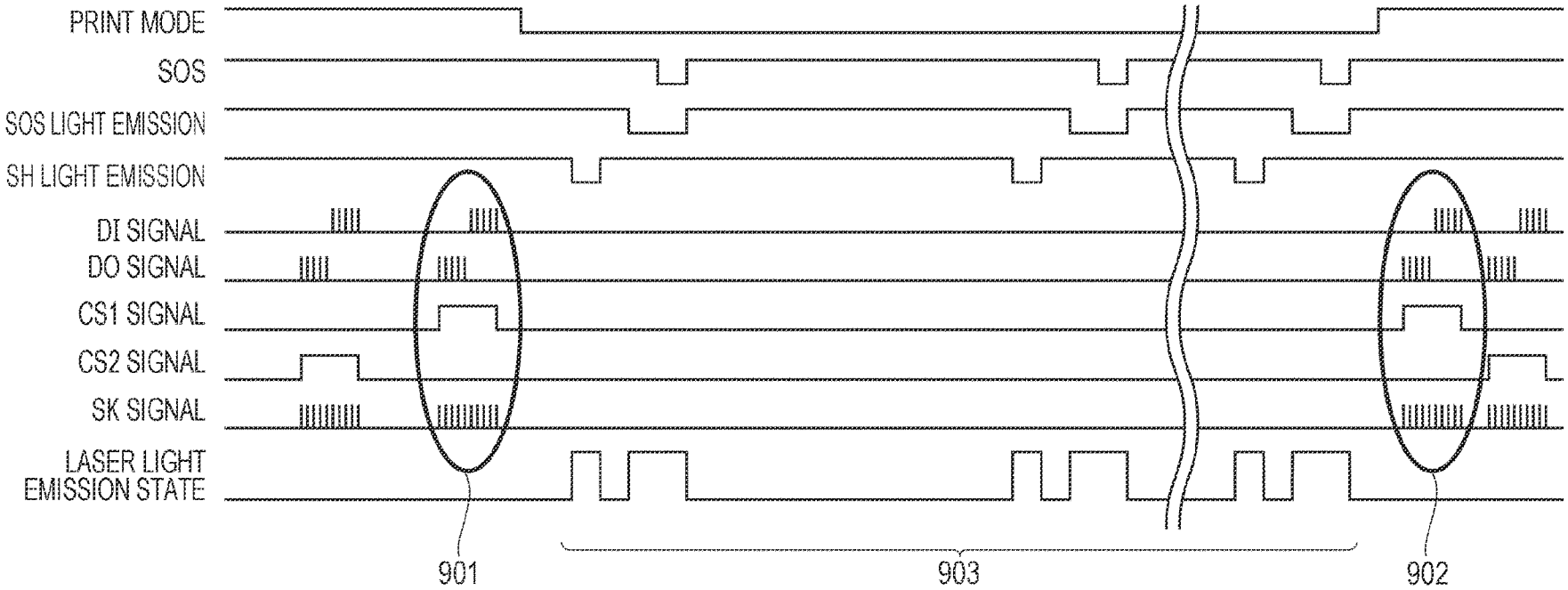
FIG. 13 is a diagram showing an example of each light emission and signal in a case where a disable function of serial communication by a controller is used in a configuration in FIG. 12.

FIG. 13 is a diagram showing an example of each light emission and signal in a case where a disable function of serial communication by the controller 180 is used in a configuration in FIG. 12. An SK signal, a DI signal, a DO signal, and CS signals (SC1 and SC2 signals) mean a serial clock signal, a data input signal, a data output signal, and select signals, respectively.

A time period 903 is a time period during which the light emission controllers 114A and 114B control light emission. In other words, the time period is a time period during which image formation processing of a print job is executed. During the time period 903, the controller 180 disables the serial communication function of the controller 180.

Alternatively, the controller 180 sets output of a select port for selecting a light emission controller 114 controlling light emission to LOW.

Therefore, serial communication 901 and serial communication 902 between the controller 180 and the light emission controllers 114A and 114B occur exclusively before and after the time period 903. As a result, a voltage drop does not occur in both the light emission controllers 114A and 114B, and deterioration in quality of a printed image does not occur.

Figure 14:
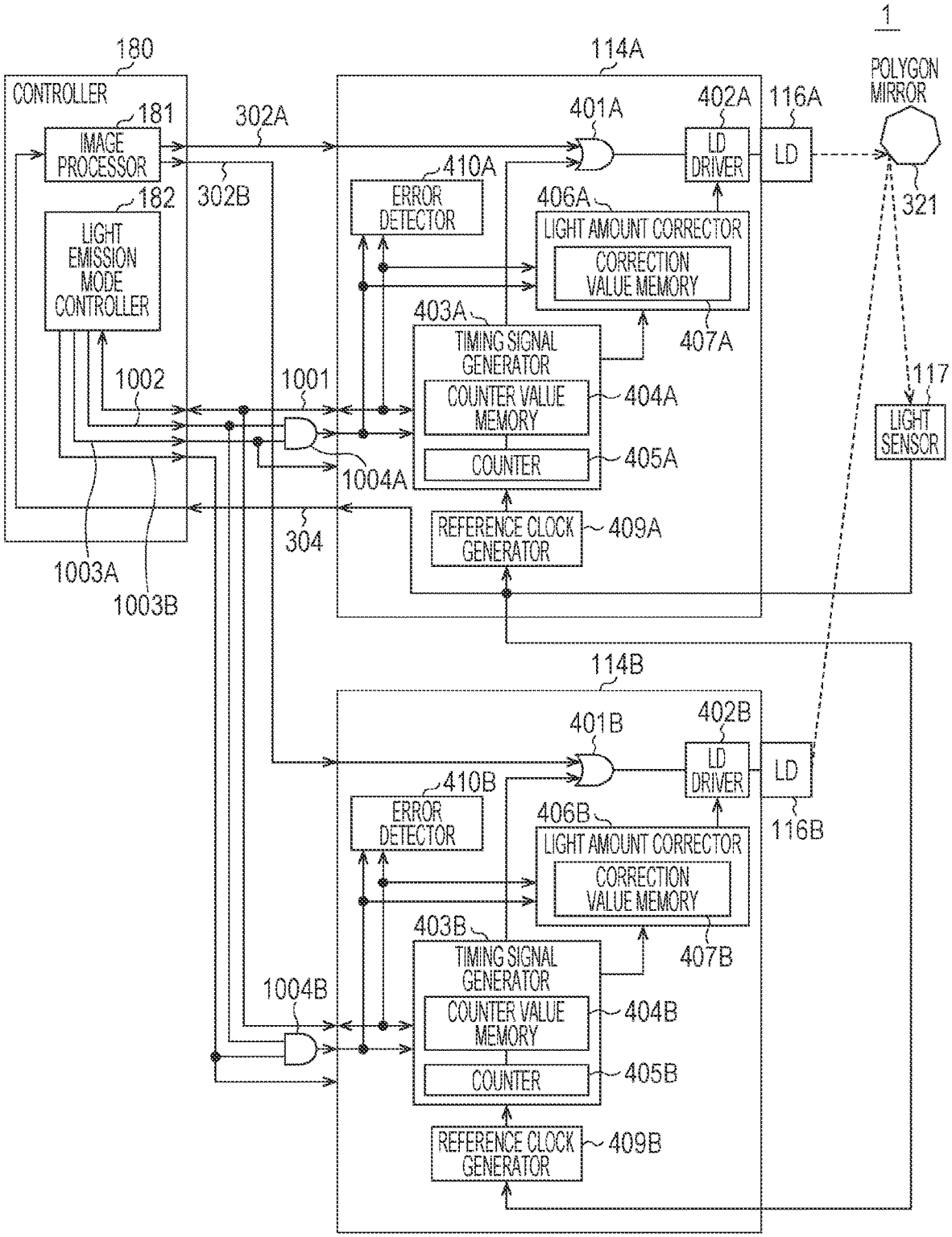
FIG. 14 is a second schematic diagram showing an example of a print head including a plurality of light emission controllers.

FIG. 14 is a second schematic diagram showing an example of the print head 113 including a plurality of light emission controllers 114. An example shown in FIG. 14 is different from the above-described configuration in that a plurality of light emission controllers 114A and 114B controls light emission, and the controller 180 disables a serial communication function of the controller 180 with hardware.

For example, the light emission controller 114A may form electrostatic latent images of yellow (Y) and cyan (C), and the light emission controller 114B may form electrostatic latent images of magenta (M) and key plate (black) (K).

In the example in FIG. 14, a signal line 1001 includes a data input signal line and data output signal line in serial communication. A signal line 1002 is a serial clock communication line. A signal line 1003A is a signal line connected to the first select pod for selecting the light emission controller 114A. A signal line 1003B is a signal line connected to the second select port for selecting the light emission controller 114B.

Each of the signal line 1002 and the signal line 1003A is connected to an input port of an AND circuit 1004A. Each of the signal line 1002 and the signal line 1003B is connected to an input port of an AND circuit 1004B.

A signal line on an output side of the AND circuit 1004A is connected to an input port for a serial clock signal in the light emission controller 114A. A signal line on an output side of the AND circuit 1004B is connected to an input port for a serial clock signal in the light emission controller 114B.

With the above-described configuration, a signal of a select port for selecting each of the light emission controllers 114A and 114B may be a signal for controlling enabling and disabling of a clock signal. More specifically, when the controller 180 generates a serial clock in a case where the controller 180 sets output of the first select port to HIGH and sets output of the second select port to LOW, the AND circuit 1004A outputs the serial clock, and the AND circuit 1004B does not output the serial clock. Thus, as in the example in FIG. 14, a serial clock to a light emission controller 114 not selected by the controller 180 is blocked by a hardware configuration, by which serial communication to the light emission controller 114 in light emission control may be more reliably prevented.

Figure 15:
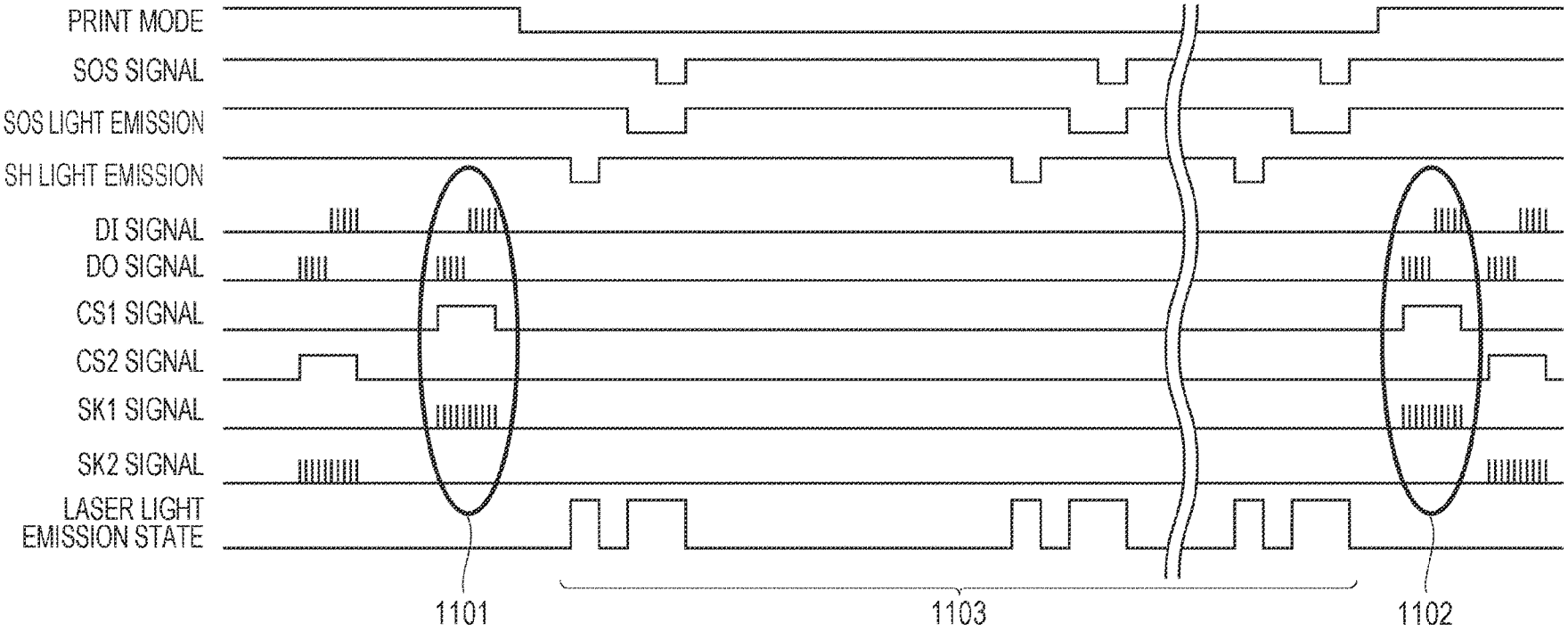
FIG. 15 is a diagram showing an example of each light emission and signal in a case where a disable function of serial communication by a controller is used in a configuration in FIG. 14.

FIG. 15 is a diagram showing an example of each light emission and signal in a case where a disable function of serial communication by the controller 180 is used in a configuration in FIG. 14. An SK1 signal is a serial clock signal output from the AND circuit 1004A to the light emission controller 114A. An SK2 signal is a serial clock signal output from the AND circuit 1004B to the light emission controller 114B.

A time period 1103 is a time period during which the light emission controllers 114A and 114B control light emission in other words, the time period is a time period during which image formation processing of a print job is executed. During the time period 1103, the controller 180 disables the serial communication function of the controller 180. Alternatively, the controller 180 disables a select port for selecting a light emission controller 114 controlling light emission, and forcibly blocks a serial clock signal to a light emission controller 114 not selected.

Therefore, serial communication 1101 and 1102 between the controller 180 and the light emission controllers 114A and 114B occur exclusively before and after the time period 1103. As a result, a voltage drop does not occur in both the light emission controllers 114A and 114B, and deterioration in quality of a printed image does not occur.

In the configuration shown in FIG. 12 or FIG. 14, the image forming apparatus 1 includes a plurality of light emission controllers 114. In a case where the image forming apparatus 1 includes a plurality of light emission controllers 114, the controller 180 transmits a signal that stops light emission of laser diodes 116A and 11613 shown in FIG. 10 to both the light emission controller 114A and the light emission controller 114B.

That is, before transmitting a signal including the control parameter to either one of the light emission controller 114A or the light emission controller 114B in order to switch light emission manner of the laser diode 116, the controller 180 transmits, to the light emission controller 114A and the light emission controller 114B, the signal that stops adjustment light emission.

That is, as shown in FIG. 10, the controller 180 transmits a signal including the control parameter for switching the mode of the laser diode 116 after the time period 903 which is after print processing on a sheet is completed. FIG. 10 shows an example in which the controller 180 transmits to the light emission controller 114 a signal that stops light emission of the laser diode 116 before transmitting a signal including a control parameter.

In FIG. 12, the controller 180 transmits a signal that stops light emission of the laser diode 116 to both the light emission controller 114A and the light emission controller 114B. Thus, the image forming apparatus 1 more reliably prevents simultaneous occurrence of a signal including a control parameter and SOS light emission in both the light emission controller 114A and the light emission controller 114B. As a result, a malfunction of the light emission controller 114 and a timing shift of light emission of the laser diode 116 are prevented.

<C. Internal Processing>

Next, internal processing related to light emission control of the image forming apparatus 1 will be described with reference to FIGS. 16 to 18. In one aspect, a CPU of the controller 180 may load a program for performing the processing in FIGS. 16 and 17 from the ROM in the controller 180 or from another storage medium on the RAM in the controller 180, and execute the program.

Figure 16:
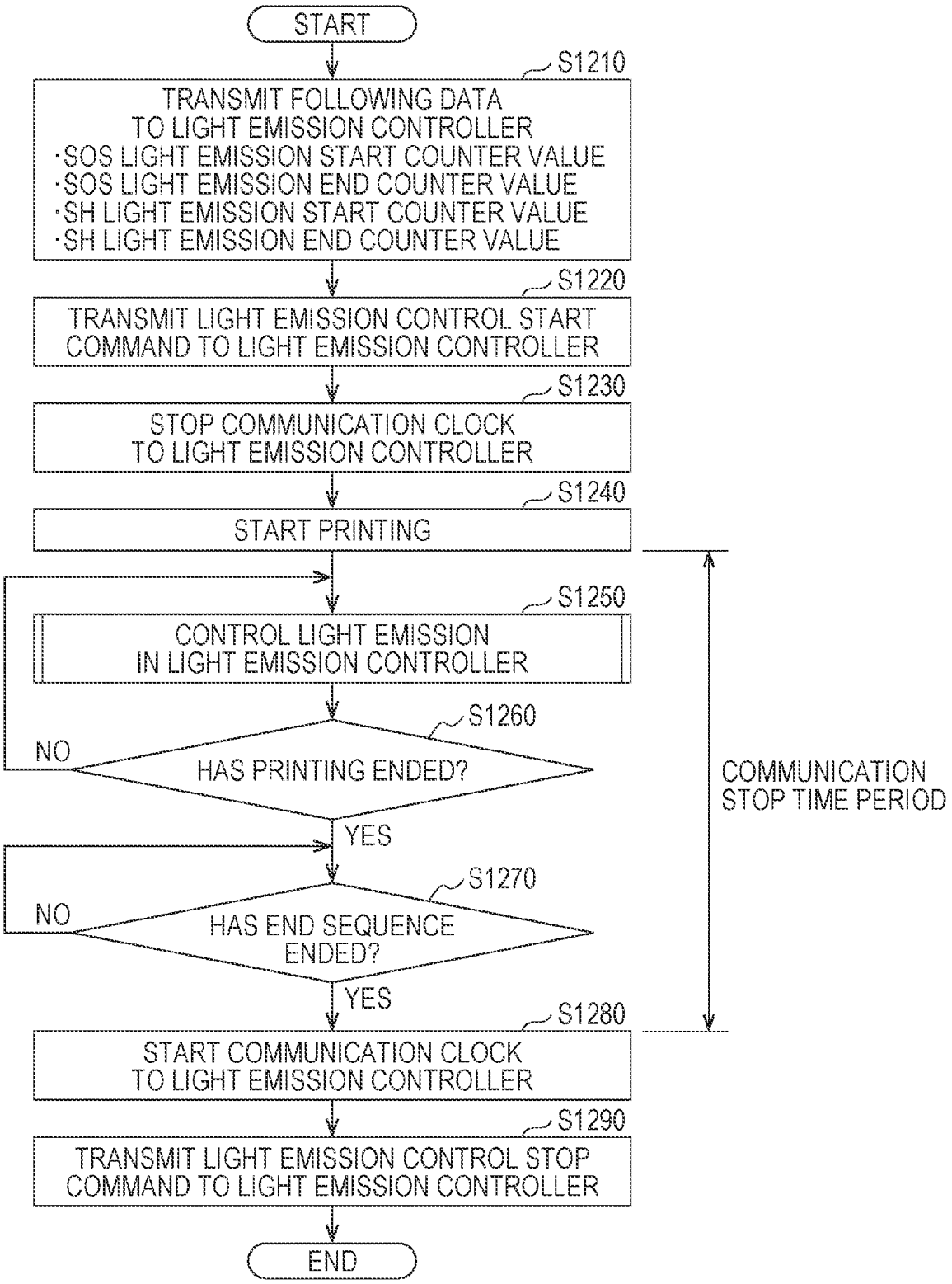
FIG. 16 is a flowchart showing an example of print processing, in the image forming apparatus.
Figure 17:
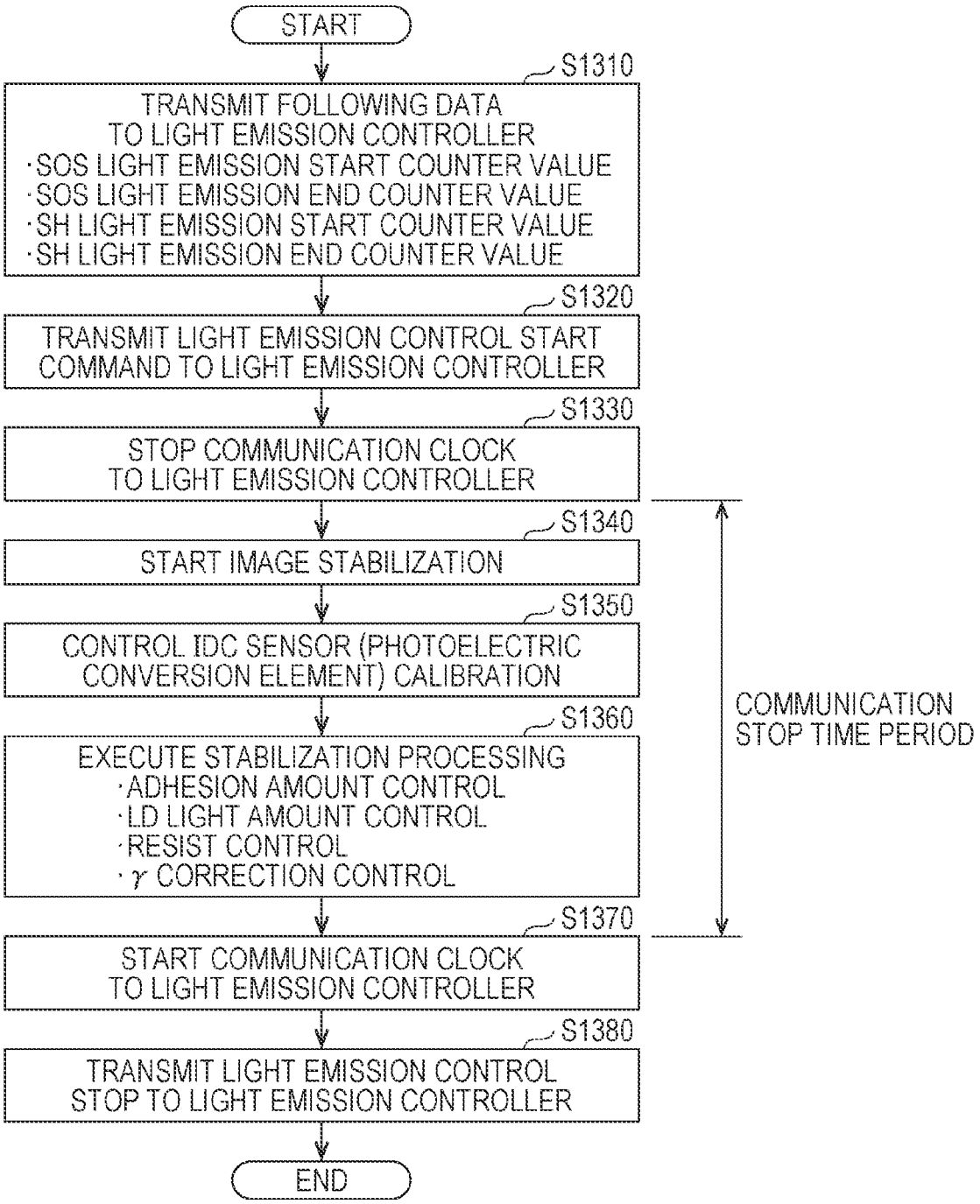
FIG. 17 is a flowchart showing an example of image stabilization processing in the image forming apparatus.

In another aspect, a part or all of the processing in FIGS. 16 and 17 may also be implemented as a combination of circuit elements formed to execute the processing.

FIG. 16 is a flowchart showing an example of print processing in the image forming apparatus 1. In step S1210, to the light emission controller 114, the controller 180 transmits an SOS light emission start counter value, an SOS light emission end counter value, an SH light emission start counter value, and an SH light emission end counter value. The light emission controller 114 stores each of these counter values in the counter value memory 404.

In step S1220, the controller 180 transmits a light emission control start command to the light emission controller 114. In step S1230, the controller 180 stops the clock of serial communication to the light emission controller 114.

More specifically, the controller 180 disables a function of a port for outputting a serial clock. In one aspect, the controller 180 may also disable a function of a data input port of serial communication and a function of data output port of serial communication.

In step S1240, the controller 180 starts print processing. The controller 180 drives an actuator such as the delivery rollers 160, the imaging unit 110, or the fixer 130. In step S1250, the light emission controller 114 controls light emission. The light emission control includes formation of an electrostatic latent image on a surface of a photoreceptors, SOS light emission, SH light emission, or the like.

In step S1260, the controller 180 decides whether or not the print processing has ended. If deciding that the print processing has ended (YES in step S1260), the controller 180 shifts the control to step S1270. If not (NO in step S1260), the controller 180 shifts the control to step S1250.

In step S1270, the controller 180 decides whether or not the end sequence processing has ended. If deciding that the end sequence processing has ended (YES in step S1270), the controller 180 shifts the control to step S1280. If not (NO in step S1270), the controller 180 repeats the processing in step S1270.

In step S1280, the controller 180 starts a communication clock to the light emission controller 114. More specifically, the controller 180 enables a function of a port for outputting a serial clock. In one aspect, the controller 180 may also enable a function of a data input port of serial communication and a function of data output port of serial communication. In step S1290, the controller 180 transmits a light emission control stop command to the light emission controller 114. In one aspect, an order of steps S1280 and S1290 may be switched.

FIG. 17 is a flowchart showing an example of image stabilization processing in the image forming apparatus 1. The image forming apparatus 1 executes image stabilization processing in a time period during which print processing is not executed, adjusts an amount of light emission of the laser diode 116, or the like.

Because processing in steps S1310 to S1330, S1370, and S1380 is the same as the processing in steps S1210 to S1230, S1270, and S1280, respectively, description of steps S1310 to S1330, S1370, and S1380 will not be repeated.

In step S1340, the controller 180 starts the image stabilization processing. The image stabilization processing includes, for example, processing of forming a test toner patch on a photoreceptor and adjusting an amount of exposure or an amount of toner supply of the photoreceptors, or the like. In step S1350, image density control (IDC) sensor calibration control is performed. In step S1360, the controller 180 executes adhesion amount control, laser diode light amount control, resist control, and correction control. The adhesion amount control is control for adjusting an amount of adhesion of toner to a photoreceptor.

The laser diode light amount control is control for adjusting an amount of light (output) of the laser diode 116. The resist control is control for adjusting a position of a sheet. The γ correction control is control for correcting gradation of an image.

FIG. 18 is a diagram showing a list of types of the stabilization processing. Each of the stabilization processing includes a different sequence. Therefore, in one aspect, the controller 180 may disable a function of a port for outputting a serial clock before starting a first sequence of each stabilization processing, and the controller 180 may enable a function of the port for outputting the serial clock after completing a last sequence of each stabilization processing.

As described above, the image forming apparatus 1 according to the present embodiment disables the serial communication function of the controller 180 during light emission control on the basis of various counter values set to the light emission controller 114. With the function, the image forming apparatus 1 prevents simultaneous occurrence of serial communication and light emission control. As a result, in the light emission controller 114, a voltage drop does not occur, a malfunction of the counter 405 due to the voltage drop does not occur, and quality of an image to be printed is improved.

As a secondary effect of the present disclosure, it is possible to implement a configuration of a double-sided substrate or less which is easily affected by voltage fluctuation without adopting an expensive configuration such as a multi-layer substrate, and it is also possible to optimize a capacitor which is one of cost reduction of a substrate.

For example, a substrate can be produced at a low cost because it is not necessary to dispose a capacitor that prevents generation of noise, such as voltage fluctuation, on the substrate.

<H. Brief Summary>

The image forming apparatus 1 according to the present embodiment includes a photoreceptor that forms a toner image, a laser diode 116 that exposes the photoreceptor, at least one light emission controller 114 that controls light emission of the laser diode 116, and a controller 180 that transmits a signal including the control parameter for controlling the laser diode 116 to the light emission controller 114. The light emission controller 114 stops light emission control over the laser diode 116 according to communication that receives the signal including the control parameter from the controller 180.

With this arrangement, a timing shift of light emission of the laser diode 116 is prevented even in a case where the light emission controller 114 receives a signal in serial communication while controlling light emission, by light emission of the laser diode 116 stopping when the light emission controller 114 receives a signal including the control parameter, and by the light emission controller 114 starting light emission of the laser diode 116 after having read the control parameter.

The light emission controller 114 controls light emission of the laser diode 116 for obtaining a horizontal synchronization signal for an exposure timing and controls light emission of the laser diode 116 for sampling an amount of light.

With this arrangement, the light emission controller 114 can control adjustment light emission with respect to the laser diode 116.

The control parameter includes a light emission timing of the laser diode 116 for obtaining a horizontal synchronization signal for an exposure timing, an amount of light of the laser diode 116, a start timing and end timing of light emission of the laser diode 116, or a transmission request related to an error in the light emission controller 114.

With this arrangement, the laser diode 116 can stop light emission when the light emission controller 114 receives a timing of adjustment light emission, an amount of light of the laser diode 116, a start timing and end timing of light emission of the laser diode 116 in response to having received a signal including the control parameter, or a signal including a request related to an error.

The light emission controller 114 stops light emission control over the laser diode 116 when receiving a signal including the control parameter from the controller 180.

With this arrangement, by the light emission controller 114 stopping the laser diode 116, the controller 180 can stop light emission of the laser diode 116 only by transmitting the signal including the control parameter.

The controller 180 transmits the signal that stops light emission of the laser diode 116 before transmitting the signal including the control parameter to the light emission controller 114.

With this arrangement, the light emission of the laser diode 116 can be more reliably stopped by transmitting from the controller 180 the signal that stops light emission of the laser diode 116.

At a time point when transmission of the signal including the control parameter ends, the controller 180 transmits to the light emission controller 114 a transmission end signal indicating an end of transmission of the signal including the control parameter, and the light emission controller 114 starts light emission control over the light emission element in response to the reception of the transmission end signal.

With this arrangement, the light emission controller 114 can start light emission of the light emission element at a time point when the transmission of the signal including the control parameter ends.

During processing of forming a toner image on the photoreceptor, the light emission controller 114 controls light emission of the laser diode 116 for obtaining a horizontal synchronization signal for an exposure timing and controls light emission of the laser diode 116 for sampling an amount of light.

With this arrangement, it is possible to control adjustment light emission during processing of forming a toner image on the photoreceptor.

A plurality of light emission modes of different light emission manners is set to the laser diode 116, and the controller 180 transmits to the light emission controller 114 a signal including the control parameter for switching a light emission mode of the laser diode 116.

With this arrangement, the laser diode 116 can stop light emission when the light emission controller 114 receives a signal for switching a light emission mode such as the stabilization mode, the inter-paper patch mode, the end sequence mode, a color mode, or a black-and-white mode.

The light emission mode includes a mode that emits light for adjusting a state of a toner image. The laser diode 116 can emit light in the stabilization mode for adjusting a state of a toner image.

A plurality of light emission controllers 114 is included, and the controller 180 transmits a signal that stops light emission of the laser diodes 116 to the plurality of light emission controllers 114 before transmitting the signal including the control parameter to any one light emission controller 114 among the plurality of light emission controllers 114. The light emission controller 114 receives the signal that steps light emission, and stops light emission control over the laser diode 116.

With this arrangement light emission of all the laser diodes 116 of the plurality of light emission controllers 114 can be stopped, and a timing shift of light emission is prevented more reliably.

There is provided a method for controlling an image forming apparatus including a photoreceptor that forms a toner image, a laser diode 116 for exposing the photoreceptor, at least one light emission controller 114 that controls light emission of the laser diode 116, and a controller 180. The controller 180 includes a step of transmitting a signal including the control parameter for controlling the laser diode 116 to the light emission controller 114, and the light emission controller 114 includes a step of stopping light emission control over the laser diode 116 according to communication that receives the signal including the control parameter from the controller 180.

With this arrangement, a timing shift of light emission of the laser diode 116 is prevented even in a case where the light emission controller 114 receives a signal in serial communication while controlling light emission, by light emission of the laser diode 116 stopping when the light emission controller 114 receives a signal including the control parameter, and by the light emission controller 114 starting light emission of the laser diode 116 after having read the control parameter.

The embodiment disclosed herein should be considered in all respects as illustrative and not restrictive. The scope of the present invention is indicated not by the description of the above embodiment but by the scope of the claims, and intended to include meanings equivalent to the scope of the claims and all modifications within the scope.

Although embodiments of the present invention have been described and illustrated in detail, the disclosed embodiments are made for purposes of illustration and example only and not limitation. The scope of the present invention should be interpreted by terms of the appended claims.

What is claimed is:

1. An image forming apparatus comprising:

a photoreceptor that forms a toner image;

a light emission element that exposes the photoreceptor;

at least one light emission controller that controls light emission of the light emission element; and a hardware processor that transmits a signal including a control parameter that enables the light emission controller to control the light emission from the light emission element, wherein the light emission controller stops transmission from the hardware processor of the signal that includes the control parameter when the light emission controller is controlling image forming light emission.

2. The image forming apparatus according to claim 1, wherein the light emission controller controls light emission of the light emission element for obtaining a horizontal synchronization signal for an exposure timing and controls light emission of the light emission element for sampling an amount of light.

3. The image forming apparatus according to claim 1, wherein the control parameter includes a light emission timing of the light emission element for obtaining a horizontal synchronization signal for an exposure timing, an amount of light of the light emission element, a start timing and end timing of light emission of the light emission element, or a transmission request related to an error in the light emission controller.

4. The image forming apparatus according to claim 1, wherein the light emission controller stops light emission control over the light emission element when receiving from the hardware processor the signal including the control parameter.

5. The image forming apparatus according to claim 1, wherein the hardware processor transmits a signal that stops light emission of the light emission element before transmitting the signal including the control parameter to the light emission controller.

6. The image forming apparatus according to claim 5, the image forming apparatus comprising the plurality of light emission controllers, wherein the hardware processor transmits a signal that stops light emission of the light emission element to the plurality of light emission controllers before transmitting the signal including the control parameter to any one the light emission controller among the plurality of light emission controllers.

7. The image forming apparatus according to claim 1, wherein, at a time point when transmission of the signal including the control parameter ends, the hardware processor transmits to the light emission controller a transmission end signal indicating an end of transmission of the signal including the control parameter, and the light emission controller starts light emission control over the light emission element in response to the reception of the transmission end signal.

8. The image forming apparatus according to claim 1, wherein, during processing of forming a toner image on the photoreceptor, the light emission controller controls light emission of the light emission element for obtaining a horizontal synchronization signal for an exposure timing and controls light emission of the light emission element for sampling an amount of light.

9. The image forming apparatus according to claim 1, wherein a plurality of light emission modes of different light emission manners is set to the light emission element, and the hardware processor transmits to the light emission controller a signal including the control parameter for switching a light emission mode of the light emission element.

10. The image forming apparatus according to claim 9, wherein the light emission mode includes a mode that emits light for adjusting a state of the toner image.

11. The image forming apparatus according to claim 1, wherein the light emission controller controls image forming light emission and adjustment light emission.

12. The image forming apparatus according to claim 11, wherein the light emission controller disables light adjustment light emission during a period when image formation processing is executed by the light emission controller.

13. A method for controlling an image forming apparatus including a photoreceptor that forms a toner image, a light emission element that exposes the photoreceptor, at least one light emission controller that controls light emission of the light emission element, and a hardware processor, the control method comprising:

transmitting, by the hardware processor, a signal including a control parameter that enables the light emission controller to control the light emission from the light emission element;

receiving, by the light emission controller, the signal including the control parameter; and stopping, by the light emission controller, transmission from the hardware processor of the signal that includes the control parameter when the light emission controller is controlling image forming light emission.

14. The method according to claim 13, wherein the light emission controller controls image forming light emission and adjustment light emission.

15. The method according to claim 14, wherein the light emission controller disables light adjustment light emission during a period when image formation processing is executed by the light emission controller.

* * * * *